US008133086B2

(12) United States Patent
Yoshida

(10) Patent No.: US 8,133,086 B2
(45) Date of Patent: Mar. 13, 2012

(54) BOAT PROPELLING APPARATUS AND BOAT

(75) Inventor: Toshifumi Yoshida, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 261 days.

(21) Appl. No.: 12/625,597

(22) Filed: Nov. 25, 2009

(65) Prior Publication Data

US 2011/0104966 A1 May 5, 2011

(30) Foreign Application Priority Data

Nov. 2, 2009 (JP) ..... 2009-252493

(51) Int. Cl.
*B63B 35/73* (2006.01)
*F02B 61/04* (2006.01)
*F02M 35/16* (2006.01)

(52) U.S. Cl. ..... 440/88 A

(58) Field of Classification Search ..... 440/88 R, 440/88 A, 88 C, 88 HE
See application file for complete search history.

(56) References Cited

U.S. PATENT DOCUMENTS 5,873,755 A * 2/1999 Takahashi et al. ..... 440/77
6,179,477 B1 * 1/2001 De Marchi ..... 385/56
2004/0149248 A1 8/2004 Koch et al.

FOREIGN PATENT DOCUMENTS

JP 7-102978 A 4/1995
JP 2004-162710 A 6/2004

* cited by examiner

*Primary Examiner* — Daniel Venne
(74) *Attorney, Agent, or Firm* — Keating & Bennett, LLP

(57) ABSTRACT

A boat propelling apparatus is compact and capable of making an adjustment on its engine output characteristic. The boat propelling apparatus includes an engine, a surge tank and an intake manifold. The intake manifold includes therein an internal space for air to flow from the surge tank, and air intake passages branching from the internal space. The intake manifold includes recesses and a boss arranged to fit an extension member to define extension passages inside the internal space.

11 Claims, 20 Drawing Sheets

BOAT PROPELLING APPARATUS AND BOAT

BACKGROUND OF THE INVENTION

1. Field of the Invention

The present invention relates to boat propelling apparatuses and boats. More specifically, the present invention relates to a boat propelling apparatus including an engine which has a plurality of cylinders, and to a boat equipped therewith.

2. Description of the Related Art

In general, boat propelling apparatuses equipped in boats have different engine output characteristics depending upon the purpose for which the boat serves. For example, boats for cruising purposes are expected to make a high-speed, long-time travel, and in this type of boat, the engine output characteristics of the boat propelling apparatus are adjusted so that high torques will be obtained in the high speed range. Likewise, bass fishing boats for example, are expected to have a superior mobility in a middle to slow speed range, and in this type of boat, the engine output characteristics of the boat propelling apparatus are adjusted so that high torques will be obtained in the middle to slow speed range.

The engine output characteristics can be adjusted by changing the length of air intake passage (air intake pipe) thereby making adjustment on an intake-air pulsation effect. Specifically, the engine output torques in a high speed range can be increased by decreasing the length of the air intake passage, and the engine output torque in a middle to slow speed range can be increased by increasing the length of the air intake passage. Changing the length of the air intake pipe based on this relationship thereby adjusting the engine output characteristic to different settings without changing the other design specifications of the engine is a conventional practice.

However, it is difficult to achieve a large increase in the length of the air intake passage (air intake pipe) in cases where there is not sufficient space available for the engine due to the design limitation. As a solution to this problem, JP-A Hei 7-102978 discloses an air supply apparatus for a V-type engine, where an air supply pipe is communicated with a collector and this collector is placed in a surge tank. The arrangement makes it possible to increase the length of the air supply pipe within a small engine room. Also in this air supply apparatus, the collector is provided with an adjusting means such as a damper, and the engine output characteristic is also adjusted by adjusting the amount of air flow.

As another example, JP-A 2004-162710 discloses an intake system for internal-combustion engine, where an intake pipe is divided into an upper intake part which is connected with an intake plenum, and a lower intake part which is fixed to the cylinder head of the internal combustion engine. Part of the upper intake part is inside the intake plenum. In this intake system, the upper intake part is replaceable with another to change the length of the portion inside the intake plenum, whereby the total length of the intake pipe can be changed. This arrangement makes it possible to change the length of the intake pipe without much changing the geometric shape of the intake system itself.

However, through validation processes from various aspects, the inventors of the present invention have found that it is difficult to make an adjustment on the engine output characteristic according to the air intake apparatus disclosed in JP-A Hei 7-102978. Specifically, in the air supply apparatus according to JP-A Hei 7-102978, it is impossible to change the length of individual air intake passages (air intake pipes) which are provided downstream from the surge tank. Due to this limitation, it is impossible to make sufficient adjustment on the intake-air pulsation effect, and therefore it is impossible to adjust the engine output characteristic sufficiently. Also, in cases where the adjusting means such as a damper is to be provided for adjustment on the amount of air flow, the air supply apparatus has to have a complicated structure, which leads to a problem of increased cost of manufacture.

There is a cost problem also in the intake system according to JP-A 2004-162710. Specifically, the invention described in JP-A 2004-162710 requires at least two kinds of upper intake parts in order to adjust the engine output characteristic. This increases manufacturing cost. The intake system according to JP-A 2004-162710 also requires an increased level of manufacturing expertise since the upper intake parts have different shapes from each other but they have to be assembled to a common lower intake part.

SUMMARY OF THE INVENTION

In view of the above, preferred embodiments of the present invention provide a boat propelling apparatus which has a compact structure for the engine output characteristic adjustments, is easy to manufacture and is low cost. Other preferred embodiments of the present invention provide a boat including such a novel boat propelling apparatus.

According to a preferred embodiment of the present invention, a boat propelling apparatus includes a surge tank; an engine having a plurality of cylinders; and an intake manifold which provides an internal space for air to enter from the surge tank, and a plurality of air intake passages branching from the internal space to supply air to each of the cylinders. The intake manifold includes a fitting portion arranged to fit an extension member to form, within the internal space, of a plurality of extension passages each corresponding to one of the air intake passages.

In a preferred embodiment of the present invention, by fitting an extension member to the fitting portion, extension passages each corresponding to one of the air intake passages can be formed within the internal space of the intake manifold. In this case, a mutually corresponding pair of the extension passage and the air intake passage constitutes essentially one air intake passage, which means that the actual air intake passage which leads to the cylinder of the engine has an increased length. Therefore, it is possible to change the length of the actual air intake passages which lead to the cylinders of the engine, by selecting whether or not to fit the extension member to the intake manifold. Since this provides a sufficient adjustment on the intake-air pulsation effect, the present invention is capable of changing the engine output torque behavior. Specifically, without the extension member being fitted as described above, the length of the actual air intake passages is short and the engine has high output torques in a high speed range. With the extension member being fitted as described above, the length of the actual air intake passages is long and the engine has high output torques in a middle to low speed range. In this case, the engine output characteristics can be changed while using the intake manifold as a common component. This eliminates the need for making a different intake manifold for a different type of target output characteristic. In other words, it is now possible to manufacture two types of boat propelling apparatuses, each having a specific output characteristic for a different purpose from the other, by simply fitting or not fitting an extension member. The arrangement makes it possible to reduce manufacturing cost of the boat propelling apparatus. Also, since the change in the engine output characteristic does not require any alteration in the shape of the intake manifold, manufacturing of the intake manifold becomes easy, which makes manufacturing of the boat propelling apparatus easy. Also, the extension of the air intake passage is achieved in the internal space. This makes it possible to make the boat propelling apparatus quite compact.

Preferably, the intake manifold includes a first member provided on a side of the engine, and a second member located farther away from the engine than the first member. The first member includes a first space formation portion which has first grooves in an equal quantity to that of the air intake passages, and second grooves provided downstream from the first space formation portion, extending continuously from the first grooves respectively. The second member includes a second space formation portion, and third grooves provided downstream from the second space formation portion and in an equal quantity to that of the air intake passages. With the above-described arrangement, the internal space is defined by at least the first space formation portion and the second space formation portion, the air intake passages are defined by at least the second grooves and the third grooves, and the fitting portion causes the extension member to be placed within the second space formation portion.

In this case, it is possible to form the internal space of at least the first space formation portion and the second space formation portion, and to form the air intake passages of at least the second grooves and the third grooves. The first space formation portion has the first grooves each extending continuously from one of the second grooves. Therefore, the extension passages can be made easily by forming the extension member with grooves each corresponding to one of the first grooves. In this case, it is possible to make the extension member in a simple structure thereby reducing manufacturing cost of the extension member. The fitting portion causes the extension member to be provided inside the second space formation portion. In this case, it is possible to make the first member very compact since there is no need for increasing the first space formation portion. Another advantage is preventing the boat propelling apparatus from being increased in width. It should be noted here that the wording that the extension member is provided inside the second space formation portion covers not only cases where the entire extension member is provided inside the second space formation portion but also cases where a portion (e.g., an end) of the extension member is outside, i.e., in the first space formation portion.

More preferably, the extension member includes a plurality of fourth grooves each corresponding to one of the first grooves, and the extension passages are defined by at least the first grooves and the fourth grooves. In this case, extension passages can be formed easily with the first grooves and the fourth grooves.

Preferably, the intake manifold includes a third member which is provided on a side of the engine, and a fourth member which is located farther away from the engine than the third member. The third member includes a third space formation portion, and fifth grooves provided downstream from the third space formation portion and in an equal quantity to that of the air intake passages. The fourth member includes a fourth space formation portion which has sixth grooves in an equal quantity to that of the air intake passages, and seventh grooves which are formed downstream from the fourth space formation portion and extending continuously from the six grooves, respectively. With the above arrangement, the internal space is formed by at least the third space formation portion and the fourth space formation portion, the air intake passages are formed by at least the fifth grooves and the seventh grooves, and the fitting portion causes the extension member to be placed within the third space formation portion.

In this case, it is possible to form the internal space of at least the third space formation portion and the fourth space formation portion, and to form the air intake passages of at least the fifth grooves and the seventh grooves. The fourth space formation portion has the sixth grooves which are formed to extend continuously from the seventh grooves. Therefore, the extension passages can be made easily by forming the extension member with grooves each corresponding to one of the sixth grooves. In this case, it is possible to make the extension member in a simple structure thereby reducing manufacturing cost of the extension member. The fitting portion causes the extension member to be provided inside the second space formation portion. In this structure, when the extension member is not fitted, the internal space of the third space formation portion has a greater volume than the internal space of the fourth space formation portion. It should be noted here, in the intake manifold, the amount of air flow in the third space formation portion is greater than the amount of air flow in the fourth space formation portion. Therefore, by providing a large volume to the internal space of the third space formation portion, it becomes possible to create a greater difference in the intake-air pulsation effect between the case where the extension member is fitted and the case where it is not fitted. It should be noted here that the wording that the extension member is provided inside the third space formation portion covers not only cases where the entire extension member is provided inside the third space formation portion but also cases where a portion (e.g., an end) of the extension member is outside, i.e., in the fourth space formation portion.

More preferably, the extension member includes a plurality of eighth grooves each corresponding to one of the sixth grooves, and the extension passages are defined by at least the sixth grooves and the eighth grooves. In this case, extension passages can be formed easily of the sixth grooves and the eighth grooves.

Preferably, the intake manifold includes a third member provided on a side of the engine, and a second member which is located farther away from the engine than the third member. The third member includes a third space formation portion, and fifth grooves which are provided downstream from the third space formation portion and in an equal quantity to that of the air intake passages. The second member includes a second space formation portion, and third grooves which are provided downstream from the second space formation portion and in an equal quantity to that of the air intake passages. With the above arrangement, the internal space is defined by at least the third space formation portion and the second space formation portion, the air intake passages are defined by at least the fifth grooves and the third grooves.

In this case, it is possible to form the internal space to include at least the third space formation portion and the second space formation portion, and to form the air intake passages to include at least the fifth grooves and the third grooves. Also, with an extension member which is a separate member that can provide the extension passages, there is no need for groove formation which is otherwise necessary for forming extension passages in the third space formation portion and the second space formation portion. This makes it possible to simplify the structure of the intake manifold thereby reducing manufacturing cost of the intake manifold, which leads to reduced manufacturing cost of the boat propelling apparatus.

More preferably, the extension member includes a first extension member which has ninth grooves in an equal quantity to that of the air intake passages, and a second extension member which has tenth grooves each corresponding to one of the ninth grooves. The extension passages are defined by at least the ninth grooves and the tenth grooves. In this case, the extension passages can be made easily with the first extension member and the second extension member.

The boat propelling apparatus described above is used suitably for boats.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments of the present invention will be described with reference to the drawings.

Figure 1:
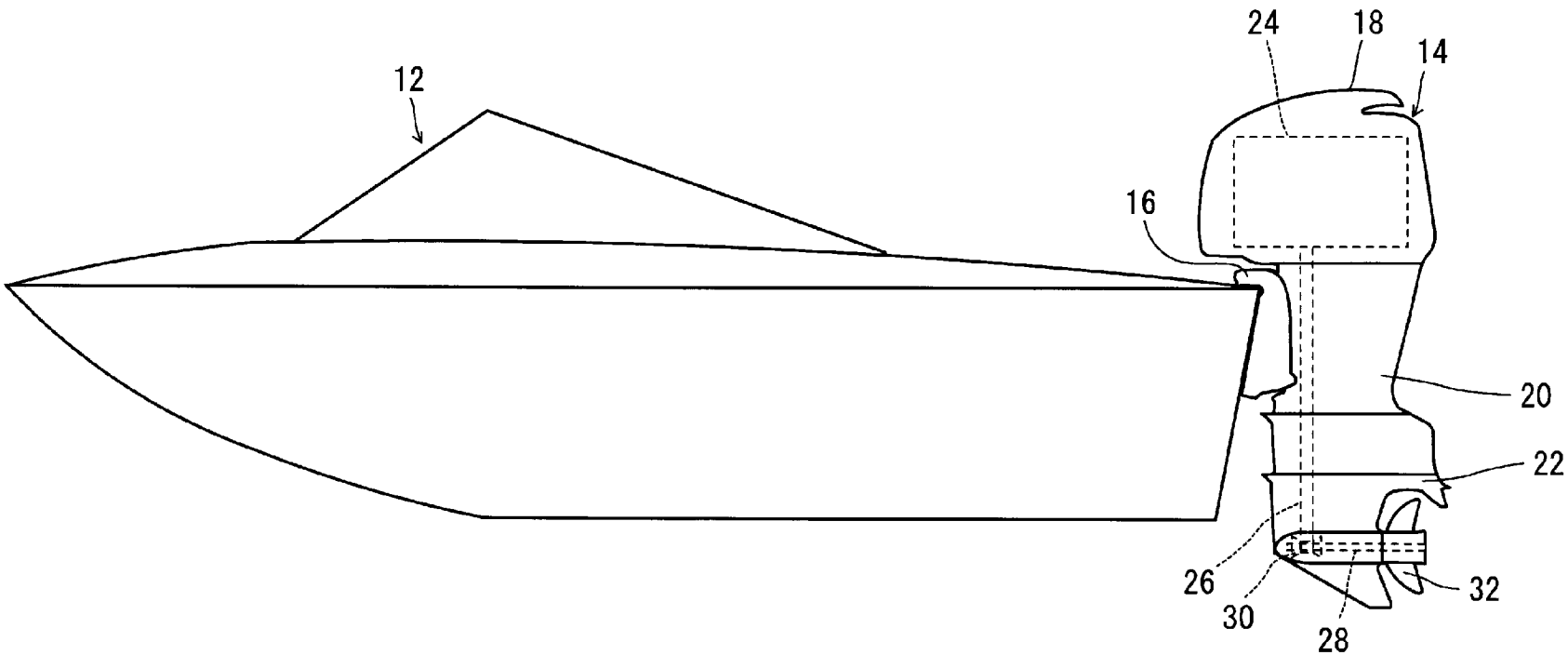
FIG. 1 is a drawing of a boat equipped with a boat propelling apparatus according to a preferred embodiment of the present invention.

FIG. 1 is a drawing of a boat which is equipped with a boat propelling apparatus according to a preferred embodiment of the present invention.

As shown in FIG. 1, a boat 10 includes a boat body 12 and a boat propelling apparatus 14. The boat propelling apparatus 14 is mounted on a rear end portion of the boat body 12 via a bracket unit 16. The boat propelling apparatus 14 has a top cowling 18, an upper case 20 and a bottom case 22. An engine 24 is provided inside the top cowling 18. It should be noted here that in order to make the description simple and concise, FIG. 1 does not show a surge tank 34 (see FIG. 2, to be described later), nor does it show intake manifolds 36 (see FIG. 2, to be described later). In reality these are connected with the engine 24.

Inside the upper case 20 and the bottom case 22, a drive shaft 26 extends in the up-down direction. The drive shaft 26 has an upper end portion connected with a crankshaft (not illustrated) of the engine 24. A propeller shaft 28 is provided rotatably inside the bottom case 22. The propeller shaft 28 has its end connected with a lower end portion of the drive shaft 26 via a bevel gear 30. The propeller shaft 28 has another end portion provided with a propeller 32 fixed thereto. With such a configuration as the above, a driving force from the engine 24 is transmitted through the drive shaft 26, the bevel gear 30 and the propeller shaft 28, to the propeller 32, enabling the propeller 32 to make normal or reverse rotation thereby generating a propelling force which causes the boat body 12 to make a forward or a backward travel.

Next, a configuration inside the top cowling 18 will be described.

Figure 2:
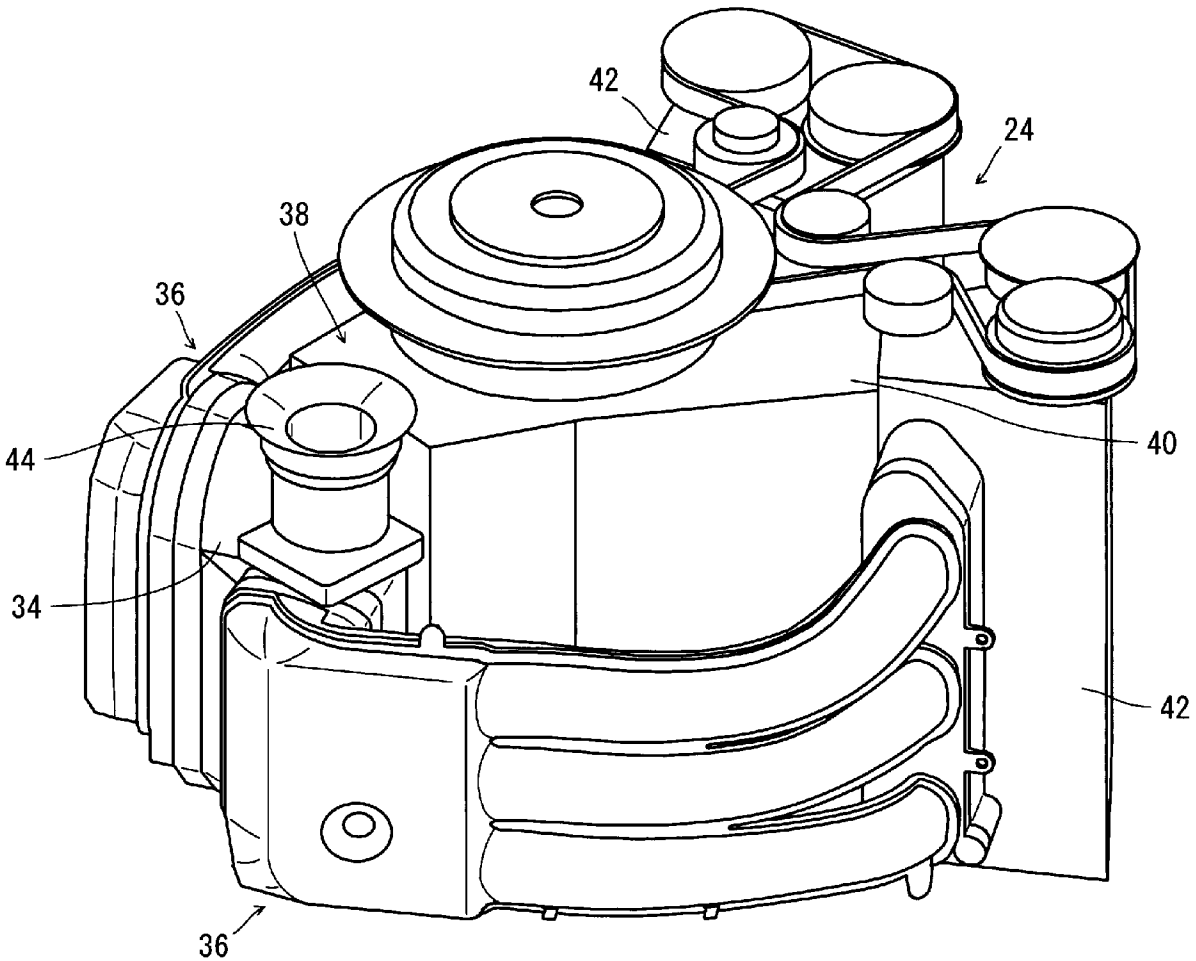
FIG. 2 is a perspective view of an engine, a surge tank and intake manifolds.
Figure 3:
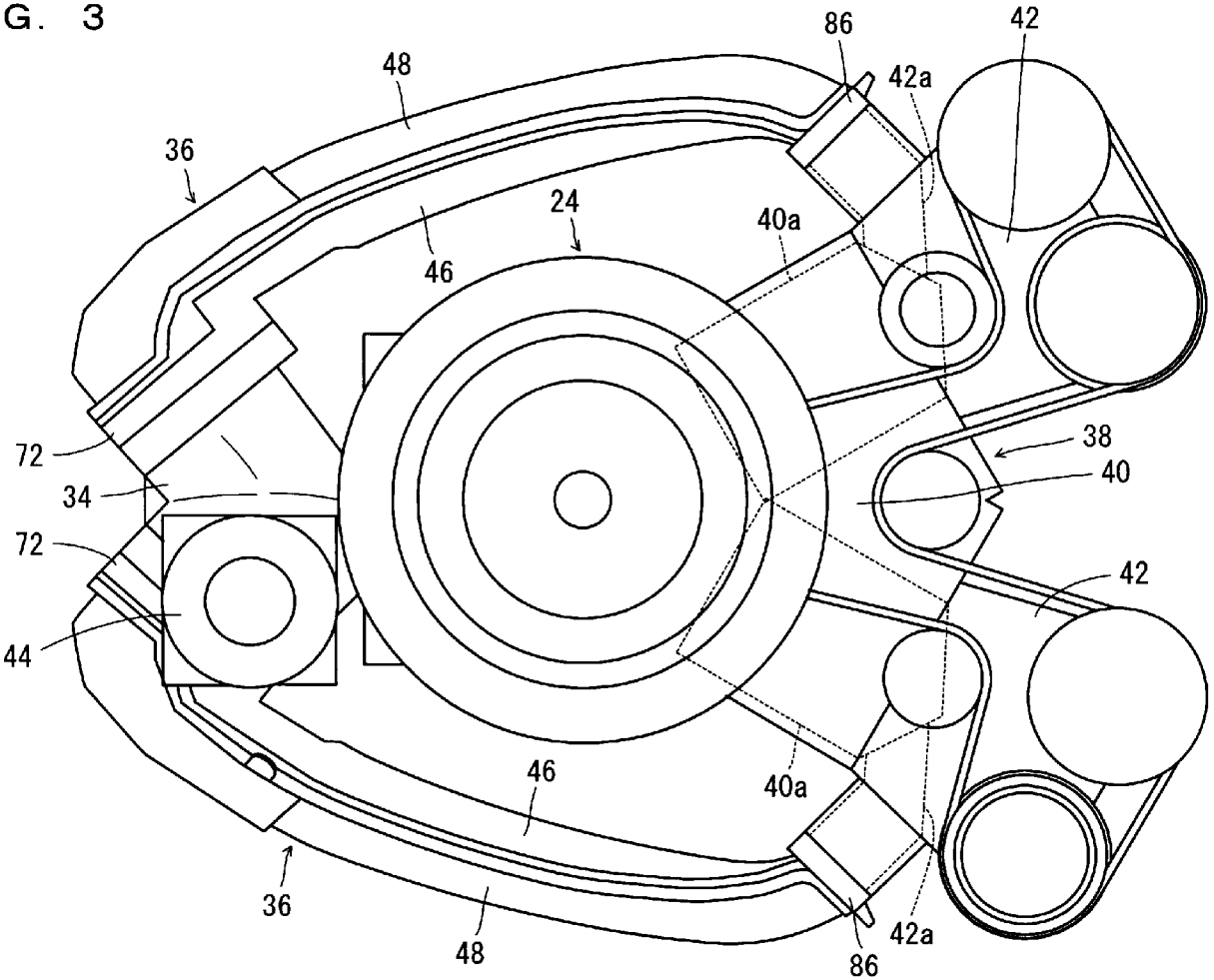
FIG. 3 is a plan view of the engine, the surge tank and the intake manifolds.

FIG. 2 is a perspective view showing the engine 24, the surge tank 34 and the intake manifolds 36 which are provided inside the top cowling 18. FIG. 3 is a plan view of the engine 24, the surge tank 34 and the intake manifolds 36.

As shown in FIG. 2, the engine 24 has an engine body 38. It should be noted here that in order to make the description simple and concise, FIG. 2 and FIG. 3 show the engine body 38 in a simplified line drawing.

The engine body 38 includes a cylinder block 40 and cylinder heads 42. Referring to FIG. 3, the engine 24 preferably is a six-cylinder V type engine, so the cylinder block 40 has six cylinders 40*a* therein, for example. Specifically, three cylinders 40*a*, arranged in the up-down direction, are provided on one side of the cylinder block 40 whereas three other cylinders 40*a*, arranged in the up-down direction, are provided on the other side of the cylinder block 40. It should be noted here that FIG. 3 shows only two cylinders 40*a* on the uppermost side. Also for simplicity, FIG. 2 does not show any of the cylinders 40*a*. Each of the cylinder heads 42 preferably includes three, for example, air intake ports 42*a*, each arranged to corresponding to one of the cylinders 40*a*. Note again that FIG. 3 shows only two air intake ports 42*a* on the uppermost side. Also for simplicity, FIG. 2 does not show any of the air intake ports 42*a*.

Each intake manifold 36 is provided on one of the two side surfaces of the engine body 38. For simplicity, in FIG. 2 and FIG. 3, the intake manifold 36 is shown in a simple line drawing. The intake manifolds 36 will be described in detail later. Each intake manifold 36 includes a first end portion, which is connected to the surge tank 34. Each intake manifold 36 has a second end portion, which is connected with the cylinder head 42. The surge tank 34 includes an upper portion provided with a cylindrical air inlet 44 which communicates with the surge tank 34. Through the air inlet 44, the surge tank 34, the intake manifold 36 and the air intake port 42*a* (see FIG. 3), air is supplied to each cylinder 40*a* (see FIG. 3) of the engine 24.

Figure 4:
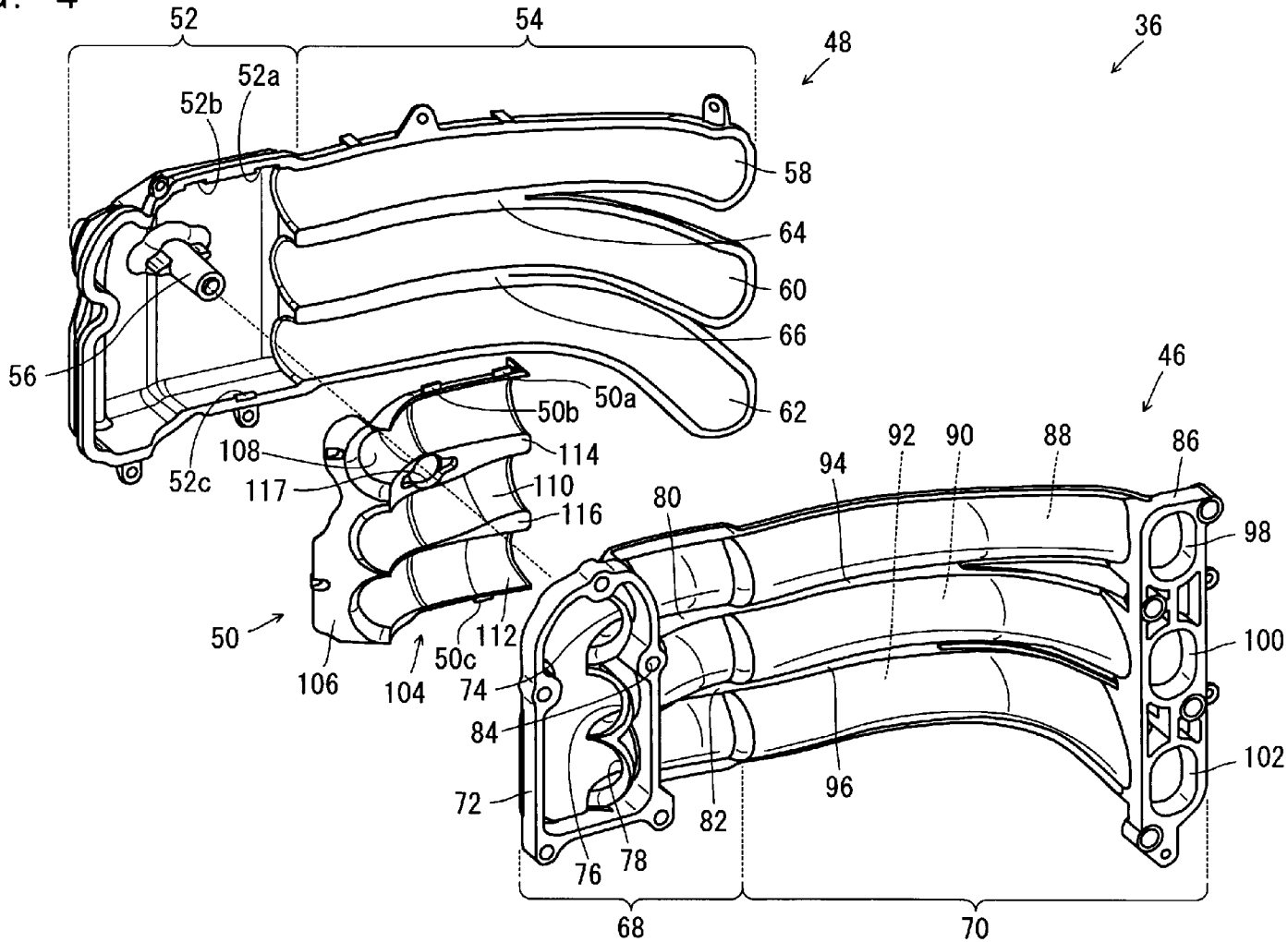
FIG. 4 is an exploded perspective view of the intake manifold (as seen from the engine side).
Figure 5:
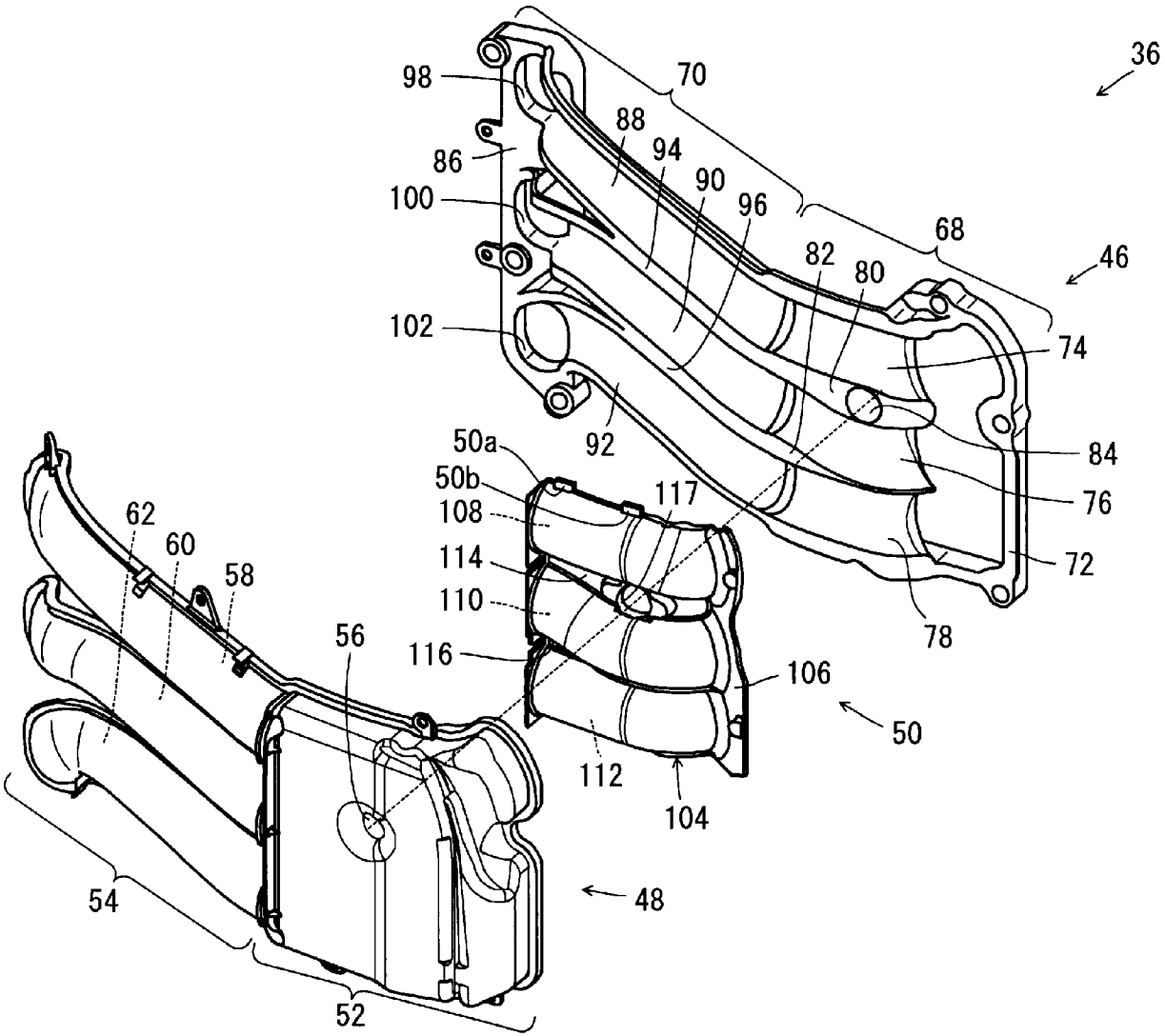
FIG. 5 is an exploded perspective view of the intake manifold (as seen from the far side in FIG. 4).
Figure 6:
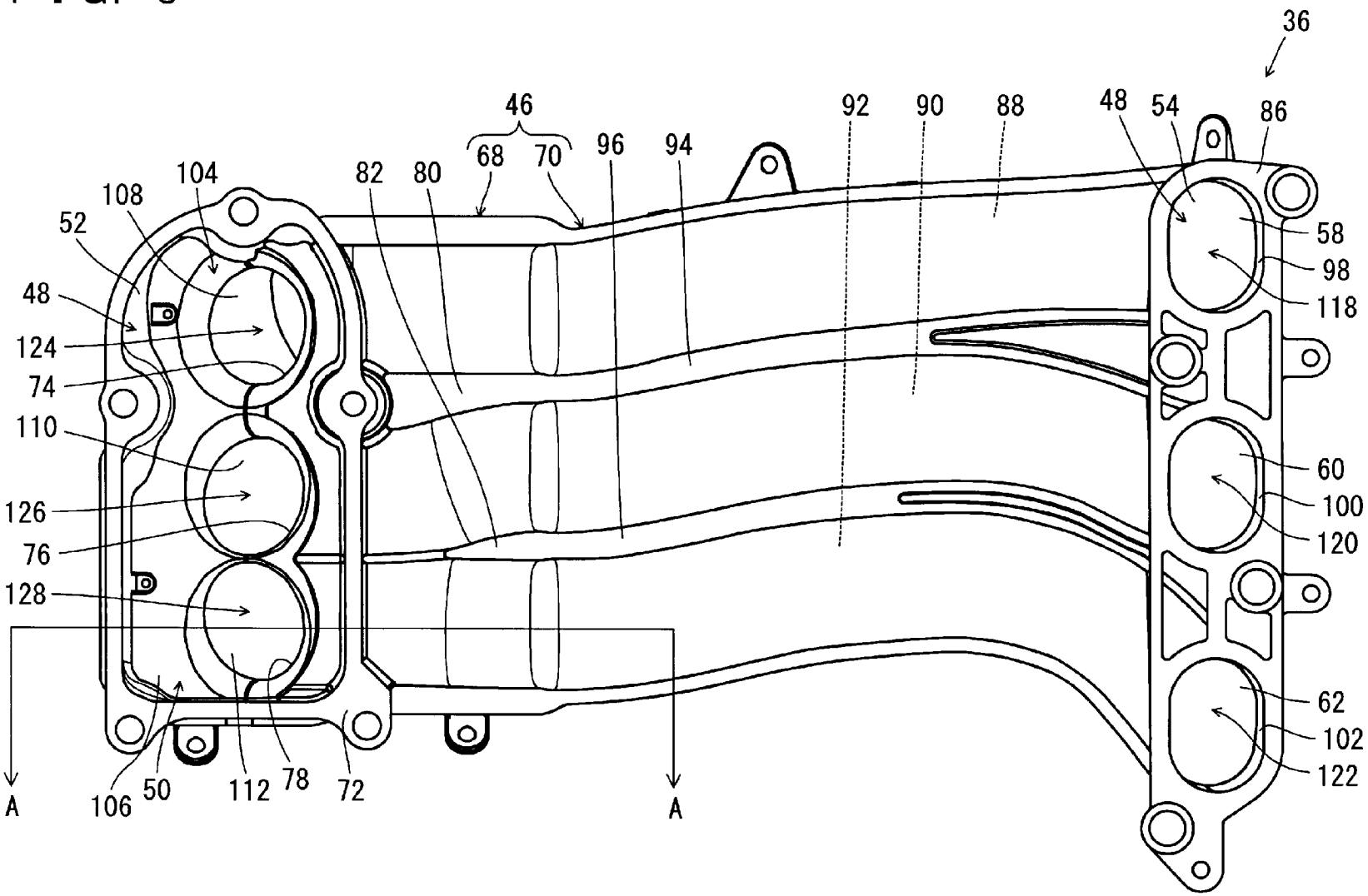
FIG. 6 is a front view of the intake manifold.
Figure 7:
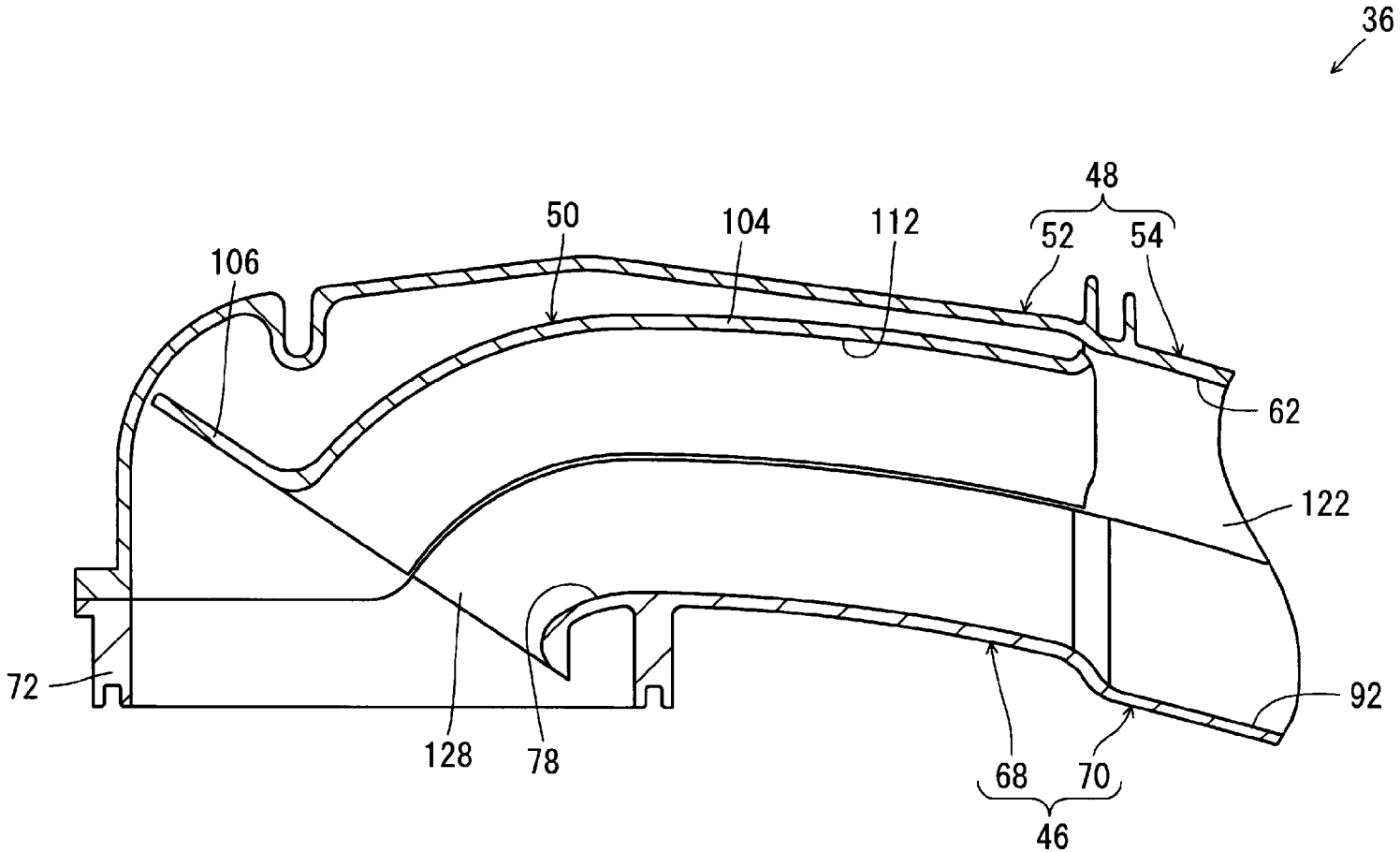
FIG. 7 is a sectional view taken in lines A-A in FIG. 6.

FIG. 4 and FIG. 5 are exploded perspective views of the intake manifold 36. FIG. 6 is a front view of the intake manifold 36 whereas FIG. 7 is a sectional view taken in lines A-A in FIG. 6. FIG. 4 and FIG. 6 are views of the intake manifold 36 from the engine 24 (see FIG. 2) whereas FIG. 5 is a view of the intake manifold 36 from the far side in FIG. 4.

Referring to FIG. 4 and FIG. 5, the intake manifold 36 includes a first member 46 provided on a side of the engine 24 (see FIG. 3) and a second member 48 which is provided farther away from the engine 24 (see FIG. 3) than the first member 46. Between the first member 46 and the second member 48, an extension member 50 is preferably fitted. The first member 46, the second member 48 and the extension member 50 may be made of resin, for example.

The second member 48 includes a space formation portion 52 and a passage formation portion 54 which is provided downstream from the space formation portion 52. The space formation portion 52 includes recesses 52*a*, 52*b*, 52*c* (see FIG. 4) formed in its end surface, and a boss 56 protruding toward the first member 46. The passage formation portion 54 including grooves 58, 60, 62 each preferably having a generally half-circle section, a division wall 64 arranged between the groove 58 and the groove 60, and a division wall 66 arranged between the groove 60 and the groove 62.

The first member 46 includes a space formation portion 68 and a passage formation portion 70 provided downstream from the space formation portion 68. When assembled to form the intake manifold 36, the space formation portion 68 faces the space formation portion 52 of the second member 48. When assembled to form the intake manifold 36, the passage formation portion 70 faces the passage formation portion 54 of the second member 48.

The space formation portion 68 has a flange portion 72, grooves 74, 76, 78 each having a generally half-circle section, a division wall 80 arranged between the groove 74 and the groove 76, and a division wall 82 arranged between the groove 76 and the groove 78. The division wall 80 has a boss hole 84 (see FIG. 5). The flange portion 72 is fixed to the surge tank 34 (see FIG. 2).

The passage formation portion 70 has a flange portion 86, grooves 88, 90, 92 each having a generally half-circle section, a division wall 94 arranged between the groove 88 and the groove 90, and a division wall 96 arranged between the groove 90 and the groove 92. The grooves 88, 90, 92 extend continuously from the grooves 74, 76, 78 respectively. The flange portion 86 includes through-holes 98, 100, 102. The through-holes 98, 100, 102 extend continuously from the grooves 88, 90, 92 respectively. The flange portion 86 is fixed to a side surface of the cylinder head 42 (see FIG. 3) so that each of the through-holes 98, 100, 102 is continuous to a corresponding one of the air intake ports 42*a* (see FIG. 3) of the cylinder head 42 (see FIG. 3).

The extension member 50 includes a passage extension portion 104 and a platy portion 106. The passage extension portion 104 includes upwardly projecting tabs 50*a*, 50*b*, downwardly projecting tab 50*c* (see FIG. 4), grooves 108, 110, 112 each having a generally half circle section, a division wall 114 arranged between the groove 108 and the groove 110, and a division wall 116 arranged between the groove 110 and the groove 112. The division wall 114 includes a boss hole 117.

The first member 46 and the second member 48 are attached, preferably via welding, for example, to each other along their outer edge portions into one piece. In this process, the division walls 64, 66 (see FIG. 4) and the division walls 94, 96 come into tight fit respectively to each other. Thus, as shown in FIG. 6, the grooves 58, 60, 62 of the passage formation portion 54 and the grooves 88, 90, 92 of the passage formation portion 70 are fitted to each other to define air intake passages 118, 120, 122.

Referring to FIG. 4 and FIG. 5, the tabs 50*a*, 50*b*, 50*c* of the extension member 50 are fitted into the recesses 52*a*, 52*b*, 52*c* in the second member 48 and bonded respectively to each other. Also, the boss 56 in the second member 48 is inserted through the boss hole 117 in the extension member 50, and then into the boss hole 84 in the first member 46. As a result, the extension member 50 is fixed to a predetermined position between the space formation portion 52 and the space formation portion 68. Specifically, the extension member 50 is fixed so that the division walls 114, 116 are in proximity to the division walls 80, 82 of the space formation portion 68, respectively. Thus, as shown in FIG. 6, the grooves 74, 76, 78 in the space formation portion 68 and the grooves 108, 110, 112 in the extension member 50 are roughly connected respectively with each other, to define extension passages 124, 126, 128.

Referring to FIG. 7, the extension member 50 is arranged so that the passage extension portion 104 is in proximity to or in contact with the passage formation portion 54. Therefore, the air intake passages 118, 120, 122 (see FIG. 6) and the extension passages 124, 126, 128 (see FIG. 6) are roughly connected respectively with each other. Referring to FIG. 6 and FIG. 7, the platy portion 106 of the extension member 50 blocks a space between the passage extension portion 104 and an inner surface of the space formation portion 52 of the second member 48. It should be noted here that complete blockage is not necessary between the outer edge of the platy portion 106 and the space formation portion 52. There may be a gap formed in between.

Referring to FIG. 6, air comes out of the surge tank 34 (FIG. 2), enters the intake manifold 36, and then branches into the extension passages 124, 126, 128. The air which enters the extension passage 124 goes through the air intake passage 118 and then into the engine 24. The air which enters the extension passage 126 goes through the air intake passage 120 and then into the engine 24 whereas the air which enters the extension passage 128 goes through the air intake passage 122 and then into the engine 24. Therefore, in the intake manifold 36, the extension passage 124 and the air intake passage 118 constitute essentially one air intake passage, the extension passage 126 and the air intake passage 120 constitute essentially one air intake passage, and the extension passage 128 and the air intake passage 122 constitute essentially one air intake passage. In order to make an adjustment on the intake-air pulsation effect of the engine 24, an adjustment must be made on the length of each above-described actual air intake passage. In the intake manifold 36, a change in the length of the above-described actual air intake passages is made by a selection as to whether or not to fit the extension member 50. Details will be described hereinafter.

Figure 8:
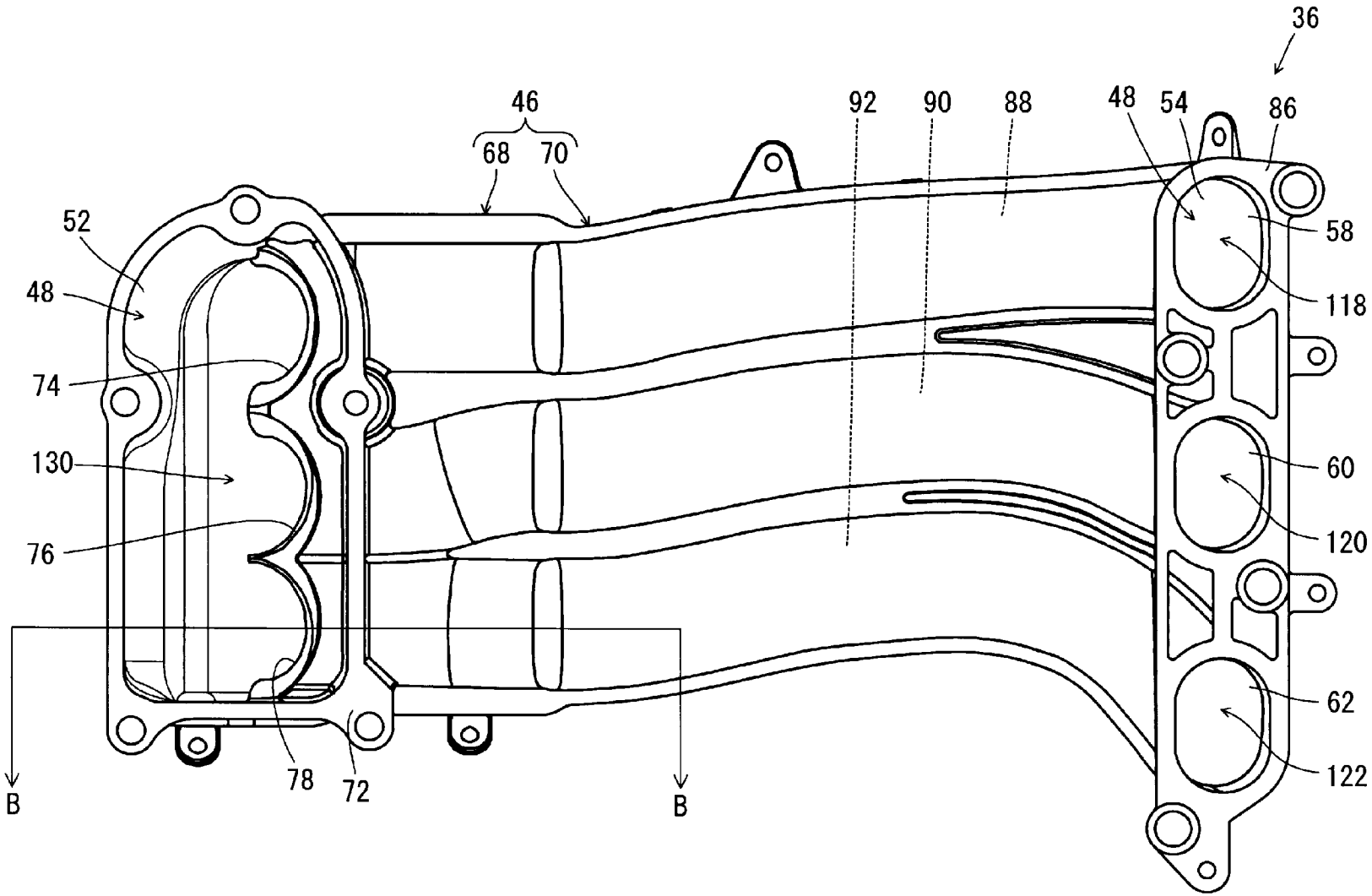
FIG. 8 is a front view of the intake manifold without an extension member fitted thereto.
Figure 9:
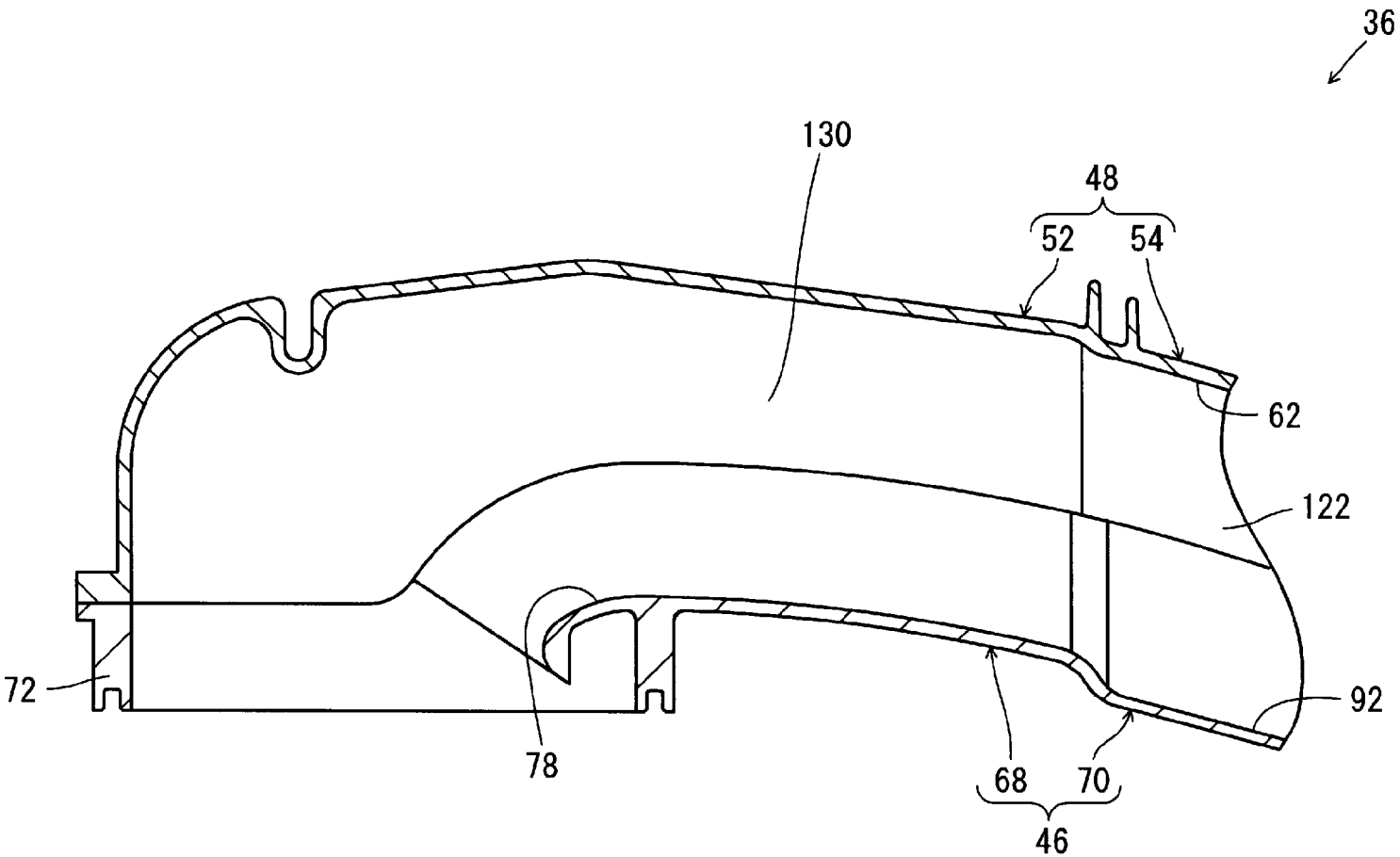
FIG. 9 is a sectional view taken in lines B-B in FIG. 8.

FIG. 8 is a front view of the intake manifold 36 without the extension member 50 fitted thereto. FIG. 9 is a sectional view taken in lines B-B in FIG. 8.

As shown in FIG. 8 and FIG. 9, there is an internal space 130 between the space formation portion 52 of the second member 48 and the space formation portion 68 of the first member 46. In the case where the extension member 50 is not fitted, there are no extension passages 124, 126, 128 (see FIG. 6) formed, and therefore, the intake manifold 36 provides an internal structure that the air intake passages 118, 120, 122 (see FIG. 6) branch from the internal space 130. Thus, air which comes from the surge tank 34 (FIG. 2) into the intake manifold 36 flows first into the internal space 130. Thereafter, the air flow is divided from the internal space 130 into the air intake passages 118, 120, 122, and then goes into the engine 24. Therefore, in the case where the extension member 50 is not fitted, the length of the individual air intake passages 118, 120, 122 is the length of the actual air intake passages which lead to the corresponding cylinders 40*a* of the engine 24 (see FIG. 3).

Hereinafter, description will cover the output characteristic change of the engine 24 based on the extension member 50.

Figure 10:
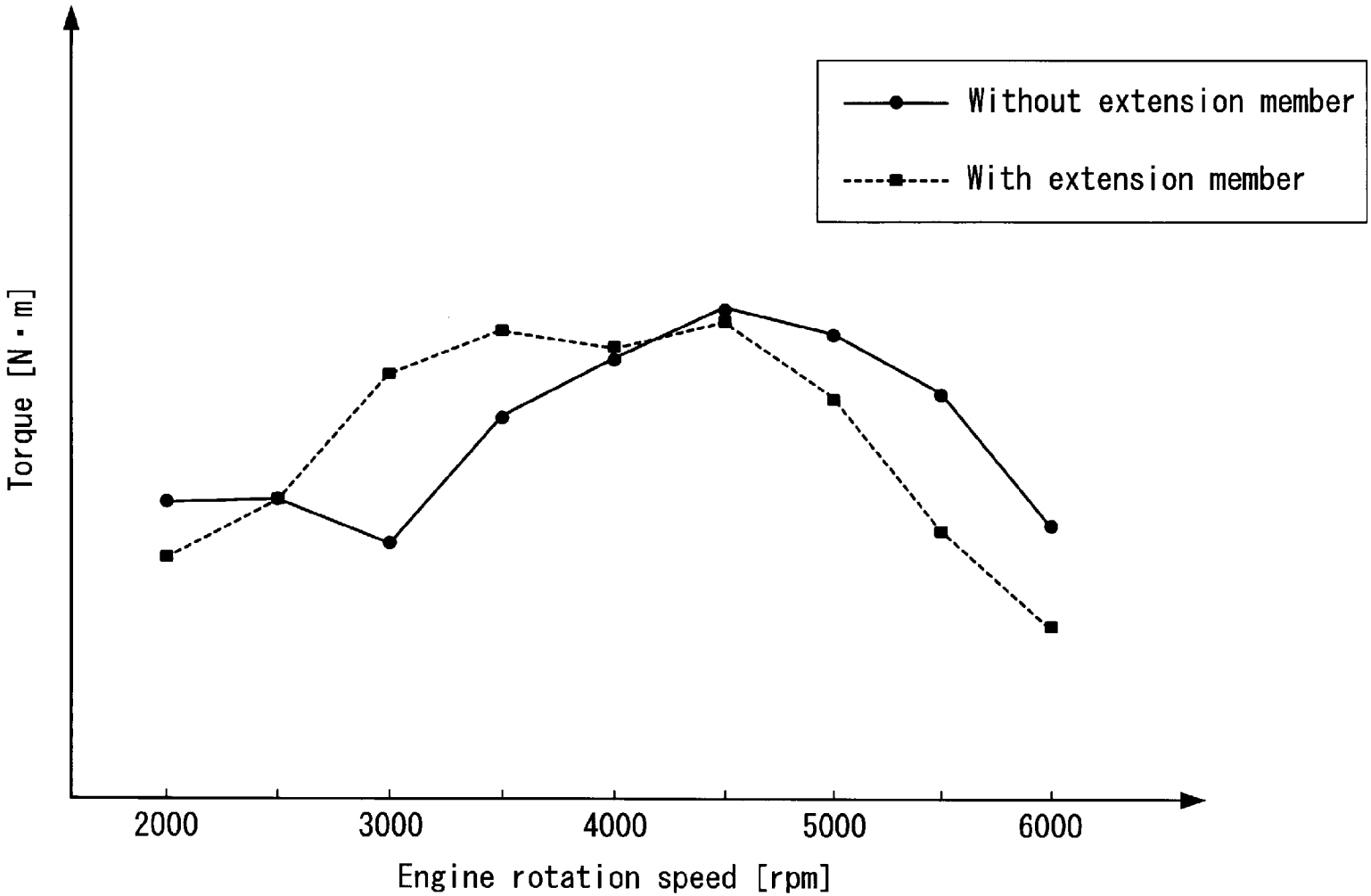
FIG. 10 is a graph which shows an engine output torque behavior with an intake manifold not fitted with an extension member, and an engine output torque behavior with an intake manifold fitted with an extension member.

FIG. 10 is a graph which shows an engine output torque behavior with the intake manifold 36 not fitted with the extension member 50, and an engine output torque behavior with the intake manifold 36 fitted with the extension member 50. In FIG. 10, a solid line indicates the output torque behavior of the engine 24 without the extension member 50 whereas a broken line indicates the output torque behavior of the engine 24 in the case where the intake manifold 36 is fitted with the extension member 50.

As shown in FIG. 10, when the intake manifold 36 is not fitted with the extension member 50, the engine 24 has high output torques in a high speed range (e.g., an rpm range of the engine 24 not lower than approximately 4,000 rpm). On the other hand, when the intake manifold 36 is fitted with the extension member 50, the engine 24 has high output torques in a middle to low speed range (an rpm range of the engine 24 not higher than approximately 4500 rpm). In other words, it is possible to improve torque rising performance in the middle to low speed range of the engine 24 by fitting the extension member 50.

In the present preferred embodiment, the recesses 52*a*, 52*b*, 52*c* and the boss 56 serve as the fitting portions, the space formation portion 68 serves as the first space formation portion, the grooves 74, 76, 78 represent the first grooves, the grooves 88, 90, 92 serve as the second grooves, the space formation portion 52 serves as the second space formation portion, the grooves 58, 60, 62 serve as the third grooves, and the grooves 108, 110, 112 serve as the fourth grooves.

As has been described, according to the boat 10 equipped with the boat propelling apparatus 14 provided by the present preferred embodiment, it is possible to change the length of the actual air intake passages which lead to individual cylinders 40*a* of the engine 24 (see FIG. 3) by selecting whether or not to fit the extension member 50. This arrangement provides sufficient level of adjustment on the intake-air pulsation effect, and is capable of changing the output torque behavior of the engine 24. Specifically, when the extension member 50 is not fitted, the actual length of air intake passages is short and output torques of the engine 24 is increased in a high speed range (e.g., an rpm range of the engine 24 not lower than approximately 4,000 rpm). When the extension member 50 is fitted, the actual length of air intake passages is long, and output torques of the engine 24 is increased in a middle to low speed range (e.g., an rpm range of the engine 24 not higher than approximately 4,000 rpm).

Therefore, in the boat 10 equipped with the boat propelling apparatus 14 according to the present preferred embodiment, it is possible to change the output characteristic of the engine 24 while using the first member 46 and the second member 48 (the intake manifold 36) as common components. This eliminates the need for making different types of the first member and of the second member (intake manifolds) for different types of target output characteristics. In other words, it is now possible to manufacture two types of boat propelling apparatuses 14, each having a specific output characteristic for a different purpose from the other, by simply choosing whether or not to fit the extension member 50. The arrangement makes it possible to reduce manufacturing cost of the boat propelling apparatus 14 and the boat 10. Also, since the change in the output characteristic of the engine 24 does not require any alteration in the shape of the intake manifold 36 itself, manufacturing of the intake manifold 36 becomes easy, which makes manufacturing of the boat propelling apparatus 14 easy. Also, the extension member 50 is provided in the internal space 130 of the intake manifold 36, specifically, the extension of the air intake passage is achieved in the internal space 130. This makes it possible to make the boat propelling apparatus 14 very compact.

Since the space formation portion 68 in the first member 46 has the grooves 74, 76, 78, the extension passages 124, 126, 128 can be provided easily by forming the extension member 50 with the corresponding grooves 108, 110, 112 for pairing with the respective grooves 74, 76, 78. In this case, the extension member 50 has a simple structure, so it is possible to reduce manufacturing cost of the extension member 50.

The extension member 50 is provided inside the space formation portion 52. In this case, it is possible to make the first member 46 very compact since there is no need for increasing the space formation portion 68. As another advantage, the arrangement prevents the boat propelling apparatus 14 from being increased in its width.

Sufficient adjustment on the intake-air pulsation effect is possible even if there is not complete contact between the division walls 114, 116 in the extension member 50 with the division walls 80, 82 in the first member 46. In this case, manufacture of the first member 46 and the extension member 50 is easy since the division walls 80, 82 and the division walls 114, 116 do not require stringent dimensional control.

It should be noted here that in the above-described preferred embodiment, the recesses 52*a*, 52*b*, 52*c* and the boss 56 are preferably provided as the fitting portions, but there may be an arrangement where only the recesses 52*a*, 52*b*, 52*c* or the boss 56 is provided as the fitting portion. Further, the quantity of the recesses is not limited to three. The quantity of the recesses may be two or less, or four or more, for example. Also, the first member may be formed with recesses as fitting portions for the tabs 50*a*, 50*b*, 50*c* to fit in, for example.

In the above-described preferred embodiment, the space formation portion 52 and the space formation portion 68 preferably define the internal space 130. However, the above-described example does not limit how the internal space 130 is provided. For example, other members may also be used in addition to the space formation portion 52 and the space formation portion 68, to provide the internal space 130.

Also in the above-described preferred embodiment, the grooves 58, 60, 62 and the grooves 88, 90, 92 define the air intake passages 118, 120, 122. However, the above-described example does not limit how the air intake passages 118, 120, 122 are formed. For example, other members may also be used in addition to the grooves 58, 60, 62 and the grooves 88, 90, 92, to define air intake passages 118, 120, 122.

The grooves 58, 60, 62, 74, 76, 78, 88, 90, 92, 108, 110, 112 need not have a half-circle section, but their sectional shape may be generally polygonal, for example. Further, the grooves 58, 60, 62 and the grooves 88, 90, 92 need not have the same size. For example, the grooves 58, 60, 62 may be greater or smaller than the grooves 88, 90, 92. Likewise, the grooves 74, 76, 78 and the grooves 108, 110, 112 need not have the same size. For example, the grooves 74, 76, 78 may be greater or smaller than the grooves 108, 110, 112.

It should be noted here that in the above-described preferred embodiment, description was made for a case where the extension member 50 is in the space formation portion 52 of the second member 48 at a position far from the engine 24. However, the above-described example does not limit how the intake manifold is configured. Hereinafter, description will cover another example of intake manifold.

Figure 11:
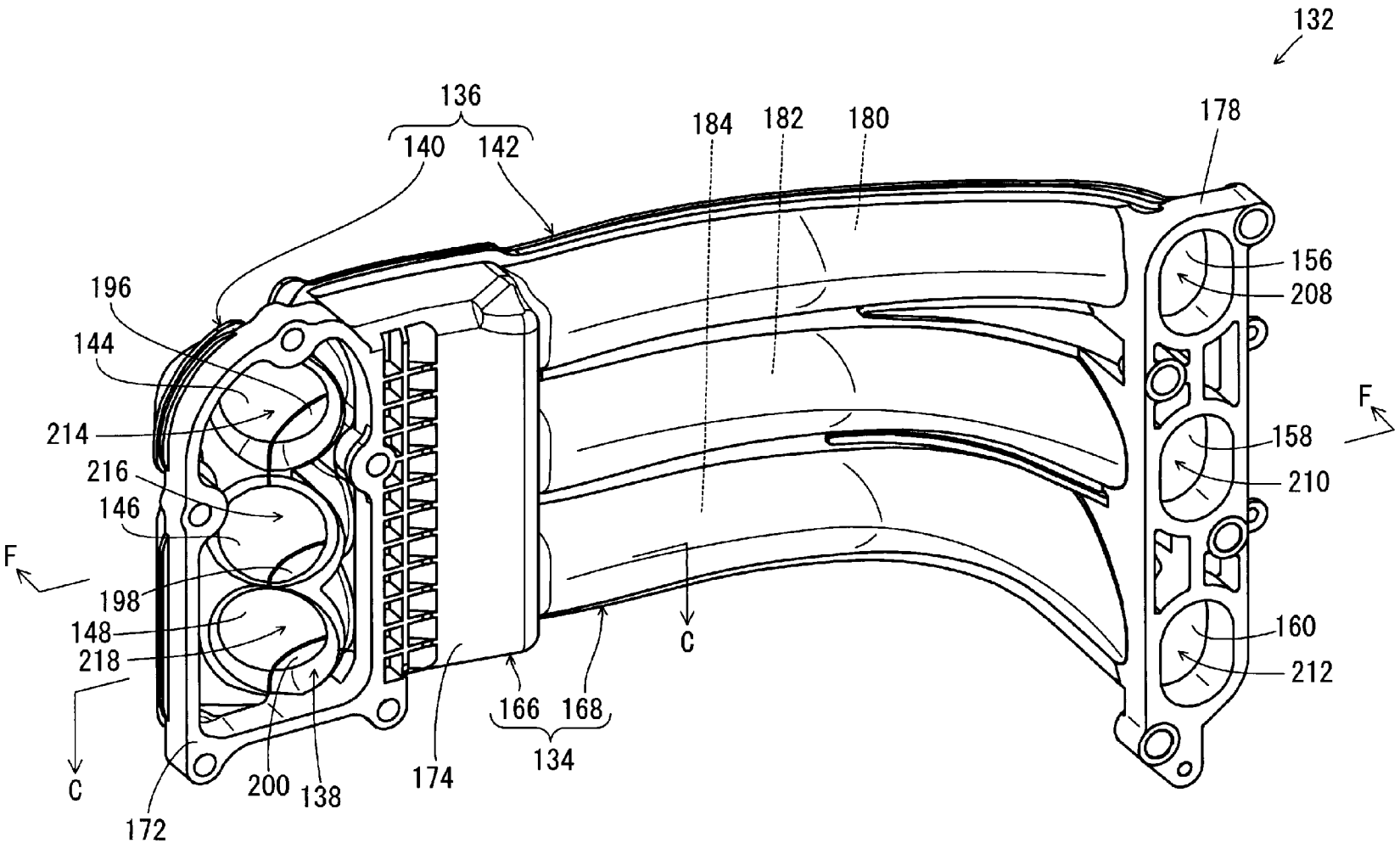
FIG. 11 is a perspective view showing another example of intake manifold.
Figure 12:
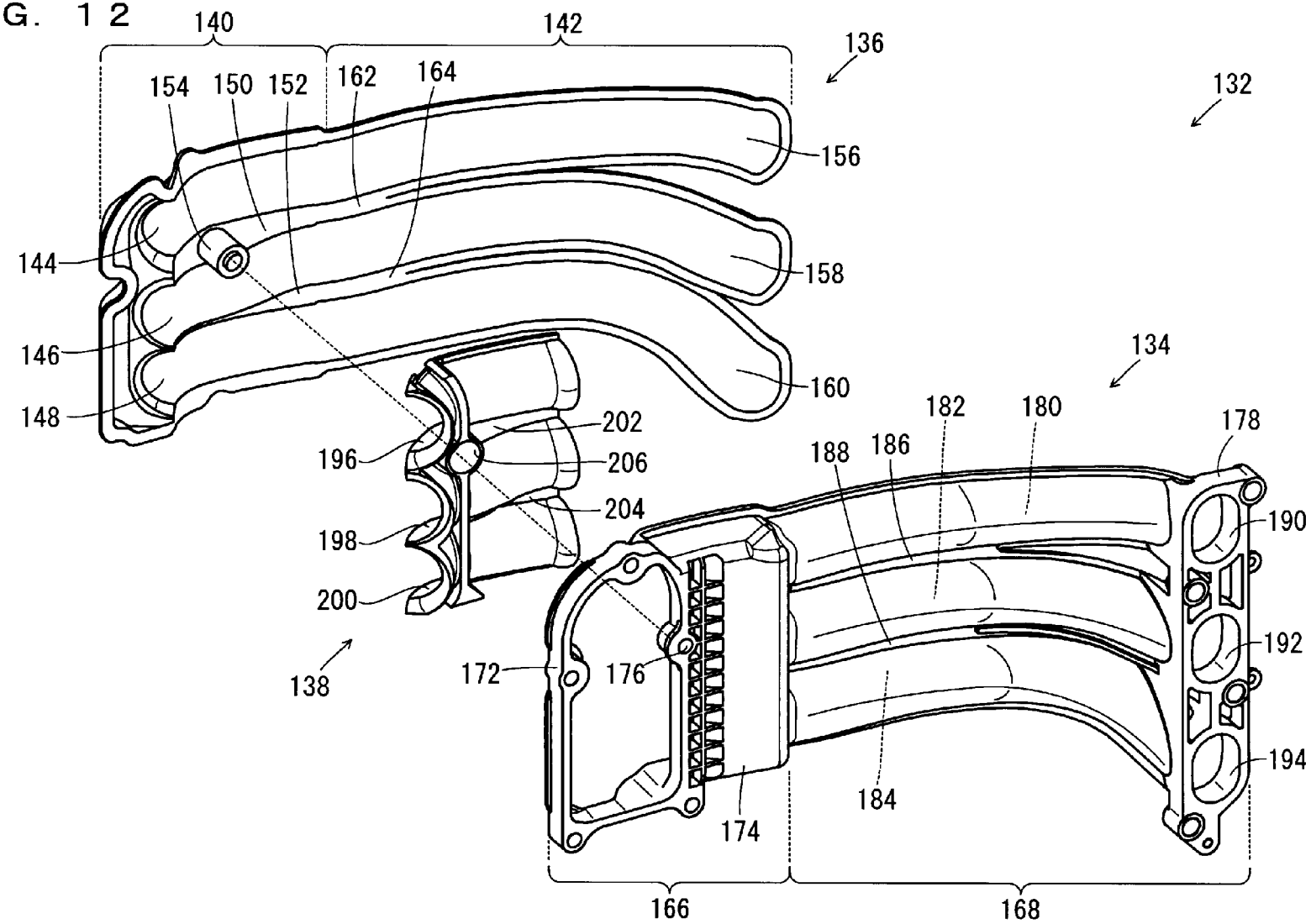
FIG. 12 is an exploded perspective view of the intake manifold in FIG. 11 (as seen from the engine side).
Figure 13:
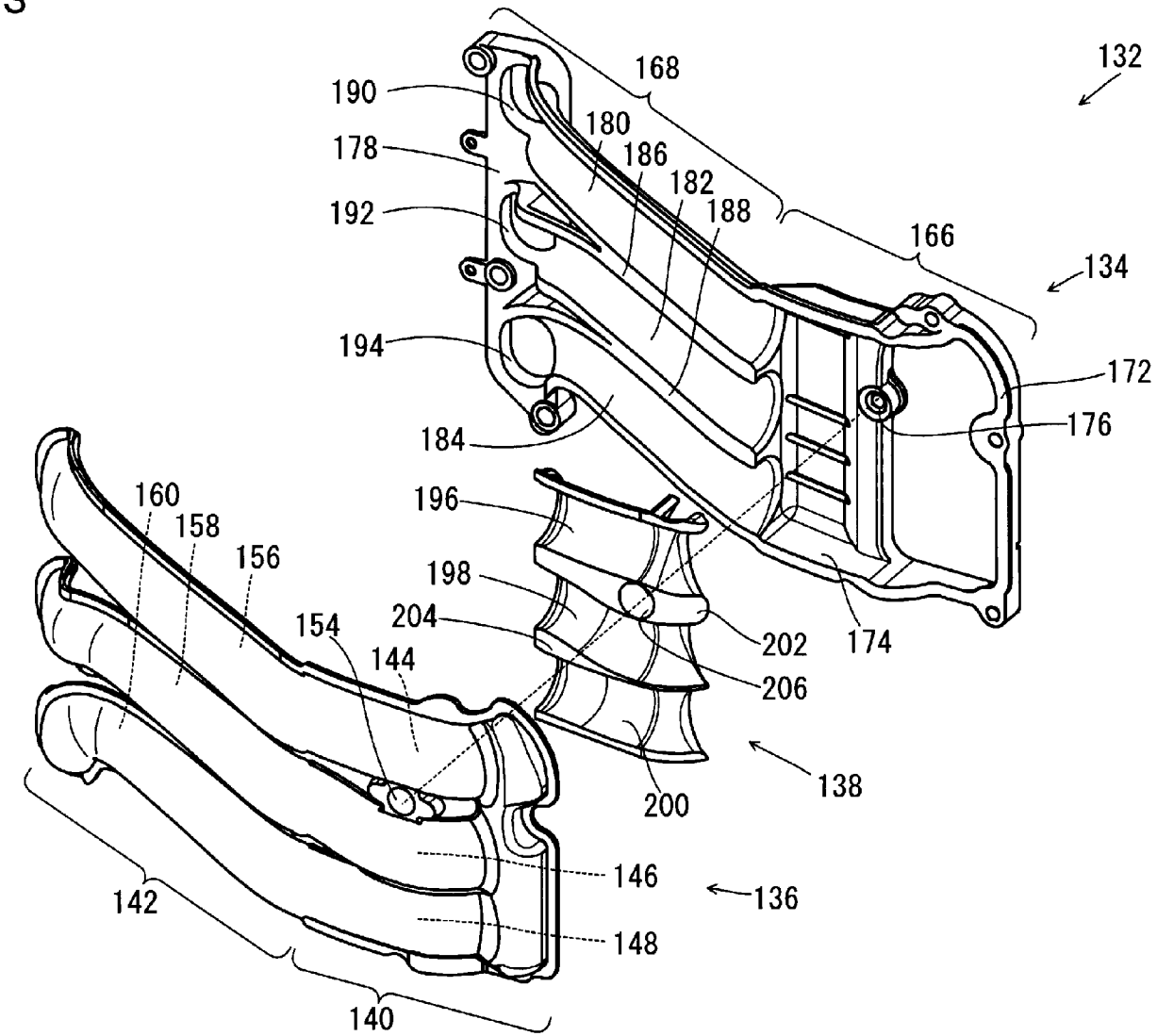
FIG. 13 is an exploded perspective view of the intake manifold in FIG. 11 (as seen from the far side in FIG. 12).
Figure 14:
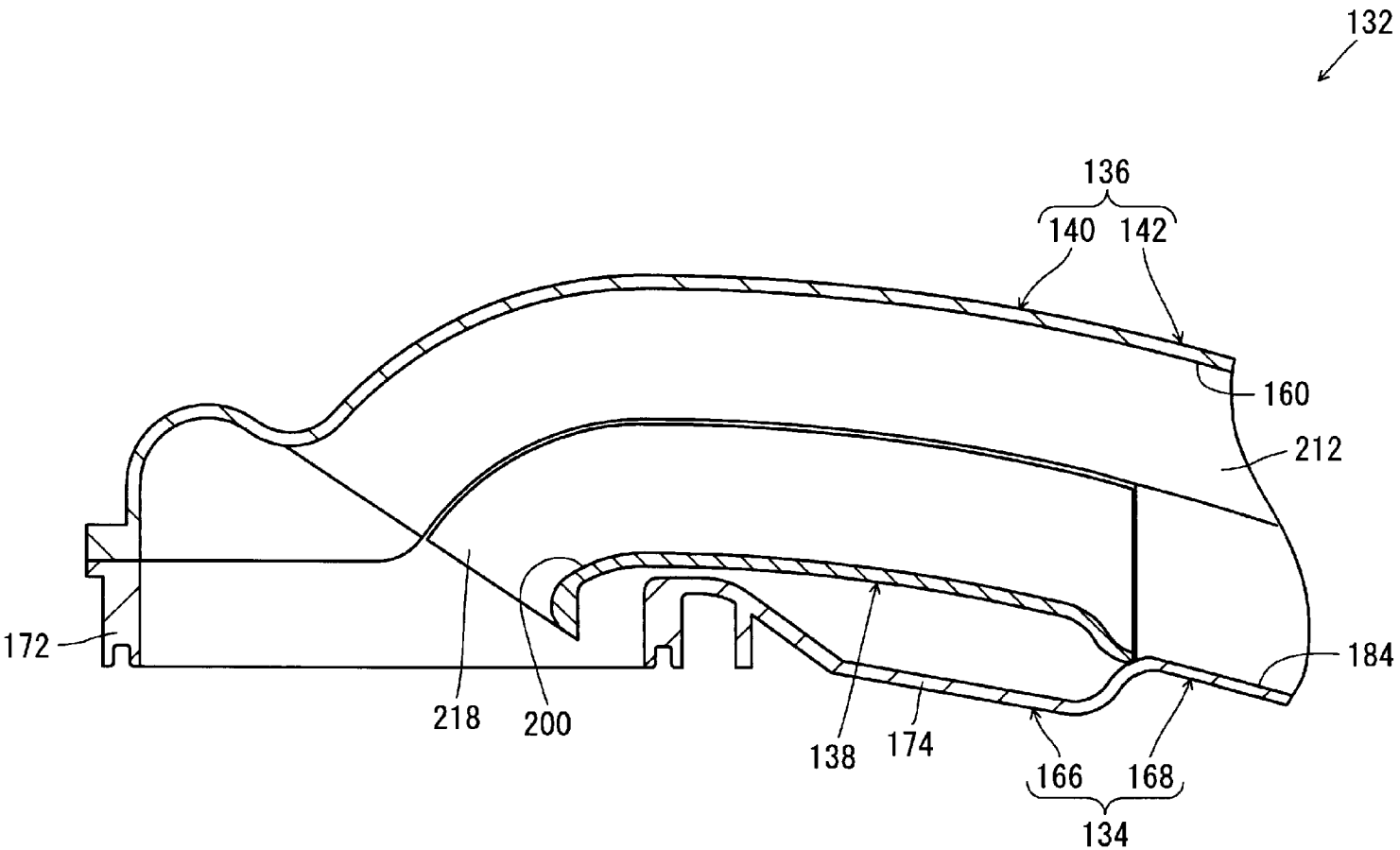
FIG. 14 is a sectional view taken in lines C-C in FIG. 11.

FIG. 11 is a perspective view showing another example of the intake manifold. FIG. 12 and FIG. 13 are exploded perspective views of the intake manifold 132 in FIG. 11. FIG. 14 is a sectional view taken in lines C-C in FIG. 11.

Referring to FIG. 11 through FIG. 13, the intake manifold 132 includes a third member 134 provided on a side of the engine 24 (see FIG. 3), and a fourth member 136 provided farther away from the engine 24 than the third member 134. Between the third member 134 and the fourth member 136, an extension member 138 is preferably fitted. The third member 134, the fourth member 136 and the extension member 138 may be made of resin, for example.

Referring to FIG. 12, the fourth member 136 includes a space formation portion 140 and a passage formation portion 142 which is provided downstream from the space formation portion 140. The space formation portion 140 includes grooves 144, 146, 148 each having a generally half-circle section, a division wall 150 arranged between the groove 144 and the groove 146; a division wall 152 arranged between the groove 146 and the groove 148; and a boss 154 provided on the division wall 150. The passage formation portion 142 includes grooves 156, 158, 160 each having a generally half-circle section, a division wall 162 arranged between the groove 156 and the groove 158, and the division wall 164 arranged between the groove 158 and the groove 160. The grooves 156, 158, 160 extend continuously from the grooves 144, 146, 148 respectively.

Referring to FIG. 13, the third member 134 includes a space formation portion 166 and a passage formation portion 168 which is provided downstream from the space formation portion 166. When assembled to form the intake manifold 132, the space formation portion 166 faces the space formation portion 140 of the fourth member 136. When assembled to form the intake manifold 132, the passage formation portion 168 faces the passage formation portion 142 of the fourth member 136.

The space formation portion 166 includes a flange portion 172, a box portion 174 and a boss hole 176 provided in the box portion 174. The flange portion 172 is fixed to the surge tank 34 (see FIG. 2).

The passage formation portion 168 includes a flange portion 178, grooves 180, 182, 184 each having a generally half-circle section, a division wall 186 arranged between the groove 180 and the groove 182, and a division wall 188 arranged between the groove 182 and the groove 184. The flange portion 178 has through-holes 190, 192, 194. The through-holes 190, 192, 194 extend continuously from the grooves 180, 182, 184 respectively. The flange portion 178 is fixed to the side of the cylinder head 42 (see FIG. 2) so that the through-holes 190, 192, 194 communicate with a corresponding one of the air intake port 42*a* (see FIG. 3) in the cylinder head 42 (see FIG. 2).

Referring to FIG. 12 and FIG. 13, the extension member 138 has grooves 196, 198, 200 each having a generally half-circle section, a division wall 202 arranged between the groove 196 and the groove 198, and a division wall 204 arranged between the groove 198 and the groove 200. The division wall 202 has a boss hole 206.

The third member 134 and the fourth member 136 are attached, preferably via welding, for example, to each other along their outer edge portions into one piece. In this process, the division walls 162, 164 (see FIG. 12) and the division walls 186, 188 (see FIG. 13) come into tight fit respectively to each other. Thus, as shown in FIG. 11, the grooves 156, 158, 160 of the passage formation portion 142 and the grooves 180, 182, 184 of the passage formation portion 168 are fit to each other to define air intake passages 208, 210, 212.

Referring to FIG. 12 and FIG. 13, the boss 154 in the fourth member 136 is inserted into the boss hole 206 of the extension member 138 and then into the boss hole 176 in the third member 134. As a result, the extension member 138 is fixed to a predetermined position between the space formation portion 140 and the space formation portion 166. Specifically, the extension member 138 is fixed so that the division walls 202, 204 are in proximity to the division walls 150, 152 (see FIG. 12) of the space formation portion 140 respectively. Thus, as shown in FIG. 11, the grooves 144, 146, 148 of the space formation portion 140 and the grooves 196, 198, 200 of the extension member 138 are roughly connected respectively with each other, to form extension passages 214, 216, 218.

Referring to FIG. 14, the extension member 138 is provided in proximity to or in contact with the passage formation portion 168. Therefore, the air intake passages 208, 210, 212 (see FIG. 11) and the extension passages 214, 216, 218 are roughly connected respectively with each other.

Referring to FIG. 11, air comes out of the surge tank 34 (see FIG. 2), enters the intake manifold 132, and then branches into the extension passages 214, 216, 218. The air which enters the extension passage 214 goes through the air intake passage 208 and then into the engine 24. The air which enters the extension passage 216 goes through the air intake passage 210 and then into the engine 24. The air which enters the extension passage 218 goes through the air intake passage 212 and then into the engine 24.

As described, in the intake manifold 132, the extension passage 214 and the air intake passage 208 constitute essentially one air intake passage, the extension passage 216 and the air intake passage 210 constitute essentially one air intake passage, and the extension passage 218 and the air intake passage 212 constitute essentially one air intake passage. In the intake manifold 132, a change in the length of the above-described actual air intake passages is made by a selection as to whether or not to fit the extension member 138. Details will be described hereinafter.

Figure 15:
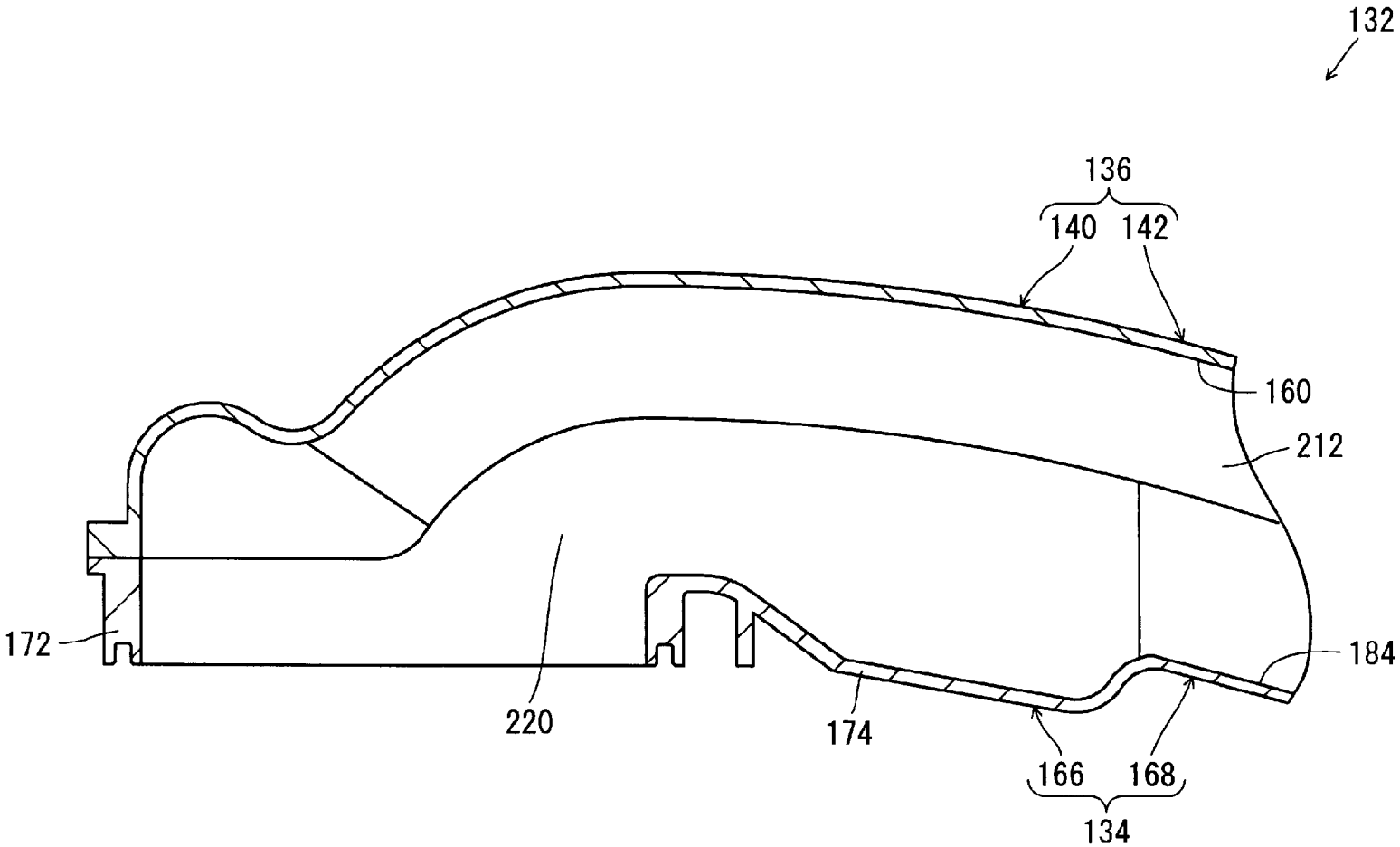
FIG. 15 is a sectional view showing an upstream side of the intake manifold (the same portion as in FIG. 14) without an extension member fitted thereto.

FIG. 15 is a sectional view showing an upstream side of the intake manifold 132 (the same portion as in FIG. 14) without the extension member 138 fitted thereto. As shown in FIG. 15, there is an internal space 220 between the space formation portion 140 of the fourth member 136 and the space formation portion 166 of the third member 134. In the case where the extension member 138 is not fitted, there are no extension passages 214, 216, 218 (see FIG. 11) formed, and therefore the intake manifold 132 provides an internal structure such that the air intake passages 208, 210, 212 (see FIG. 11) branch from the internal space 220. Thus, air which comes from the surge tank 34 (FIG. 2) into the intake manifold 132 flows first into the internal space 220. Thereafter, the air flow is divided from the internal space 220 into the air intake passages 208, 210, 212, and then goes into the engine 24. Therefore, in the case where the extension member 138 is not fitted, the length of the individual air intake passages 208, 210, 212 is the length of the actual air intake passages which lead to the corresponding cylinders 40*a* (see FIG. 3) of the engine 24 (see FIG. 3).

In the present preferred embodiment, the boss 154 serves as the fitting portion, the space formation portion 166 serves as the third space formation portion, the grooves 180, 182, 184 serve as the fifth grooves, the space formation portion 140 serves as the fourth space formation portion, the grooves 144, 146, 148 serve as the sixth grooves, the grooves 156, 158, 160 serve as the seventh grooves, and the grooves 196, 198, 200 serve as the eighth grooves.

As has been described, in the intake manifold 132 according to the present preferred embodiment, it is again possible, as in the intake manifold 36 described above, to change the length of the actual air intake passages which lead to individual cylinders 40*a* of the engine 24 by selecting whether or not to fit the extension member 138 thereto. This arrangement provides sufficient level of adjustment on the intake-air pulsation effect, and is capable of changing the output torque behavior of the engine 24. In this case, it is possible to change the output characteristic of the engine 24 by using the third member 134 and the fourth member 136 (the intake manifold 132) as common components. This eliminates the need for making different types of the third member and fourth member (the intake manifold). In other words, it is possible to manufacture two types of boat propelling apparatuses, each having a specific output characteristic for a different purpose from each other, by simply choosing whether or not to fit the extension member 138. The arrangement makes it possible to reduce manufacturing cost of the boat propelling apparatus and boats. Also, since the change in the output characteristic of the engine 24 does not require any partial alteration in the shape of the intake manifold 132 itself, manufacturing of the intake manifold 132 becomes easy, which makes manufacturing of the boat propelling apparatus easy. Also, the extension member 138 is provided in the internal space 220 of the intake manifold 132, specifically, the extension of the air intake passage is achieved in the internal space 220. This makes it possible to make the boat propelling apparatus in a compact size.

Since the space formation portion 140 in the fourth member 136 includes the grooves 144, 146, 148, the extension passages 214, 216, 218 can be provided easily by providing the extension member 138 with corresponding grooves 196, 198, 200 for pairing with the respective grooves 144, 146, 148. In this case, the extension member 138 has a simple structure, so it is possible to reduce manufacturing cost of the extension member 138.

In this preferred embodiment, the extension member 138 is preferably provided inside the space formation portion 166. In this structure, the internal space 220 of the space formation portion 166 has a greater volume than the internal space 220 of the space formation portion 140. It should be noted here, in the intake manifold 132, the amount of air flow in the space formation portion 166 is greater than the amount of air flow in the space formation portion 140. Therefore, by giving a large volume to the internal space 220 of the space formation portion 166, it becomes possible to create a greater difference in the intake-air pulsation effect between the case where the extension member 138 is fitted and the case where it is not.

Sufficient adjustment on the intake-air pulsation effect is possible even if there is not a complete contact between the division walls 202, 204 in the extension member 138 with the division walls 150, 152 in the fourth member 136. In this case, manufacture of the fourth member 136 and the extension member 138 is easy since the division walls 150, 152 and the division walls 202, 204 do not require stringent dimensional control.

It should be noted here that in the above-described preferred embodiment, the boss 154 is preferably provided as the fitting portion, but there may be an arrangement, like the recesses 52*a*, 52*b*, 52*c* in the second member 48 in FIG. 4, that one or more recesses are provided as fitting portions in the space formation portion of the third member or in the space formation portion of the fourth member. In this case, the extension member is provided with one or more tabs correspondingly to the one or more recesses in the space formation portion. It should be noted here that both of the boss 154 and the recess may be provided as the fitting portion, or only one of them may be provided as the fitting portion.

In the above-described preferred embodiment, the space formation portion 140 and the space formation portion 166 preferably provide the internal space 220. However, the above-described example does not limit how the internal space 220 is provided. For example, other members may also be used in addition to the space formation portion 140 and the space formation portion 166, to provide the internal space 220.

Also in the above-described preferred embodiment, the grooves 156, 158, 160 and the grooves 180, 182, 184 preferably define the air intake passages 208, 210, 212. However, the above-described example does not limit how the air intake passages 208, 210, 212 are formed. For example, other members may also be used in addition to the grooves 156, 158, 160 and the grooves 180, 182, 184, to form air intake passages 208, 210, 212.

The grooves 144, 146, 148, 156, 158, 160, 180, 182, 184, 196, 198, 200 need not have a half-circle section, but their sectional shape may be generally polygonal, for example. Further, the grooves 144, 146, 148 and the grooves 196, 198, 200 need not have the same size. For example, the grooves 144, 146, 148 may be greater or smaller than the grooves 196, 198, 200. Likewise, the grooves 156, 158, 160 and the grooves 180, 182, 184 need not have the same size. For example, the grooves 156, 158, 160 may be greater or smaller than the grooves 180, 182, 184.

In the above-described preferred embodiments, description was made for a case where the extension member is provided in the second member or the third member of the intake manifold. However, these preferred embodiments do not limit the way the extension member is provided. Hereinafter, still another example of the intake manifold will be described.

Figure 16:
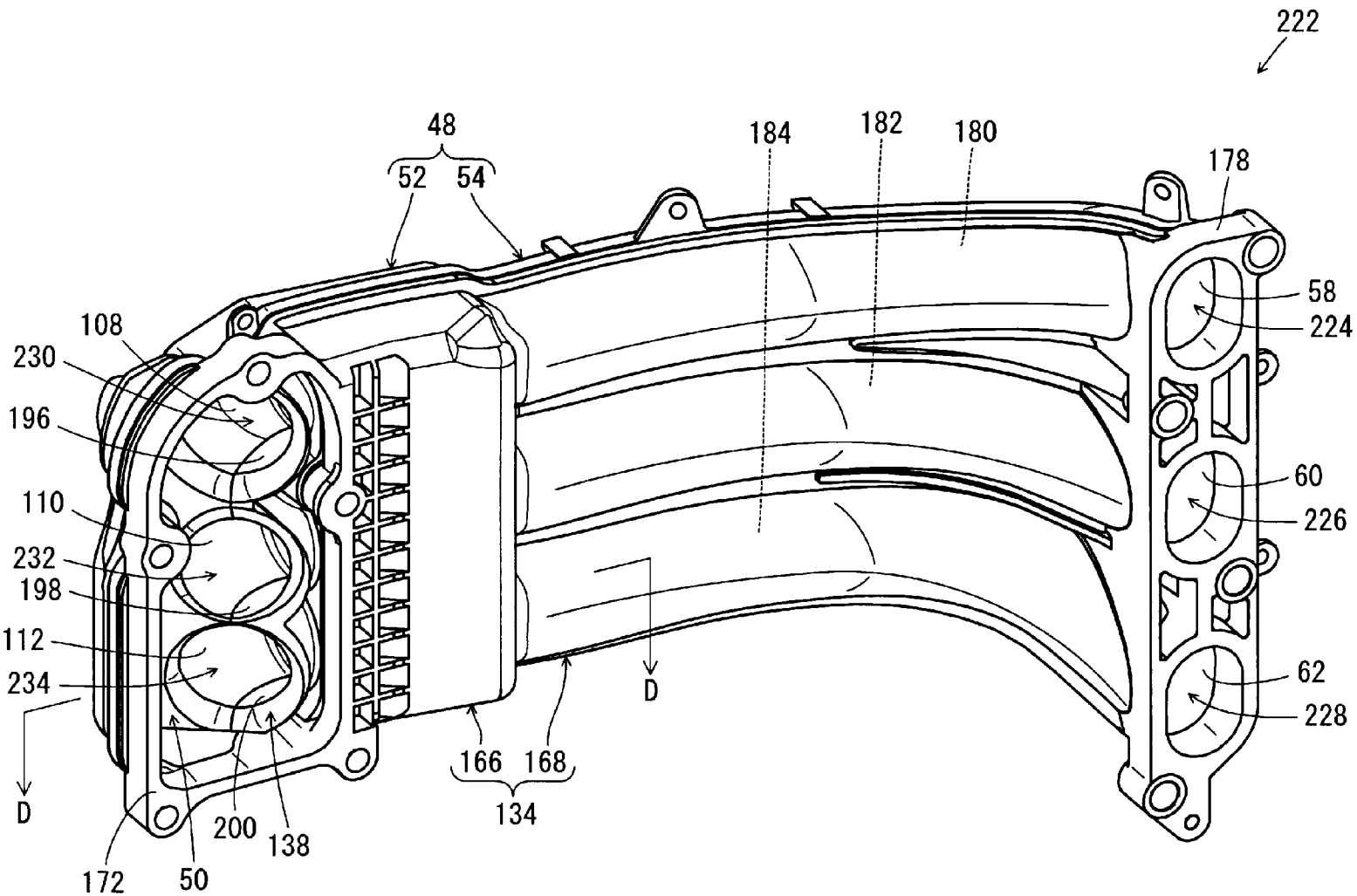
FIG. 16 is a perspective view showing still another example of the intake manifold.
Figure 17:
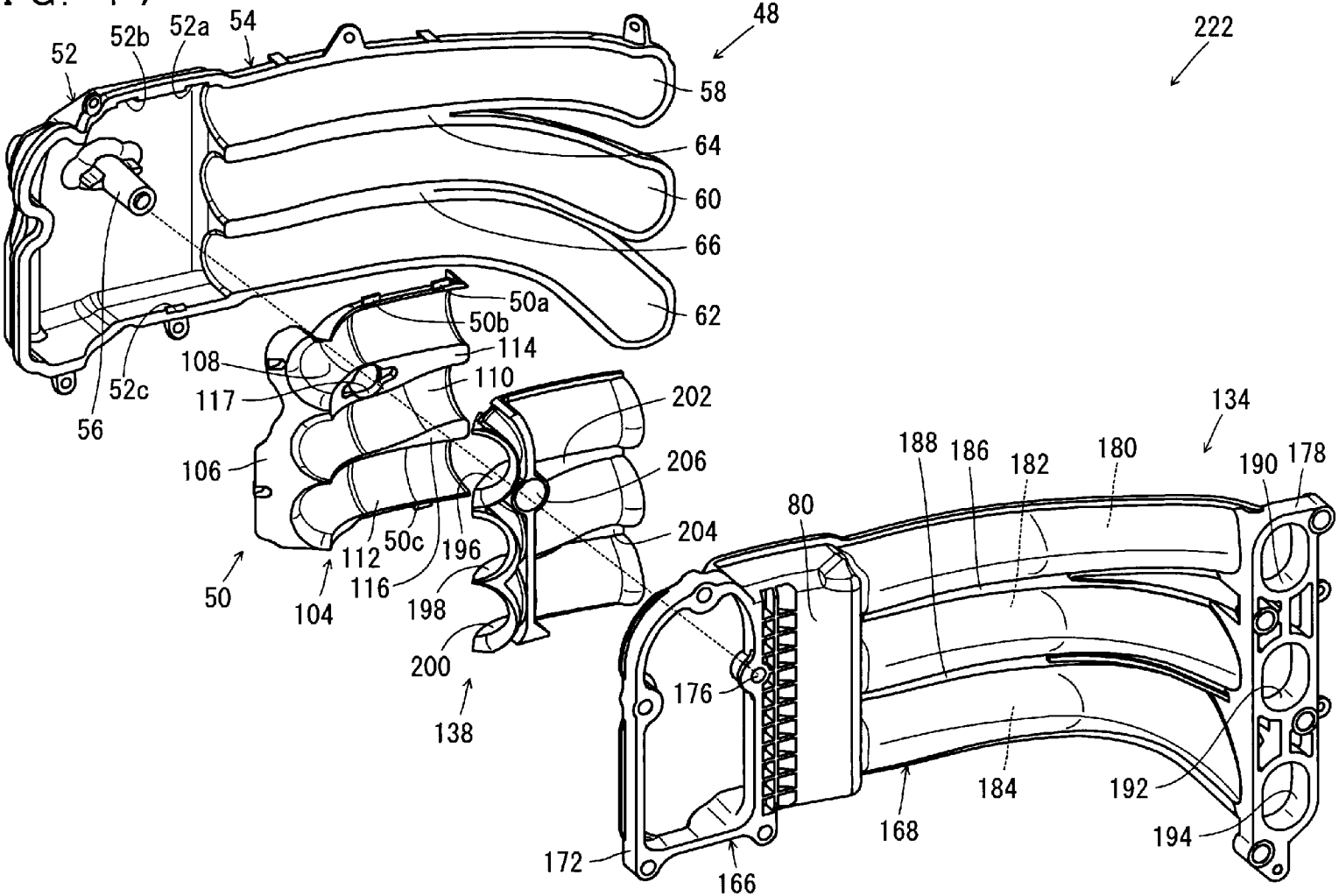
FIG. 17 is an exploded perspective view of the intake manifold in FIG. 16.
Figure 18:
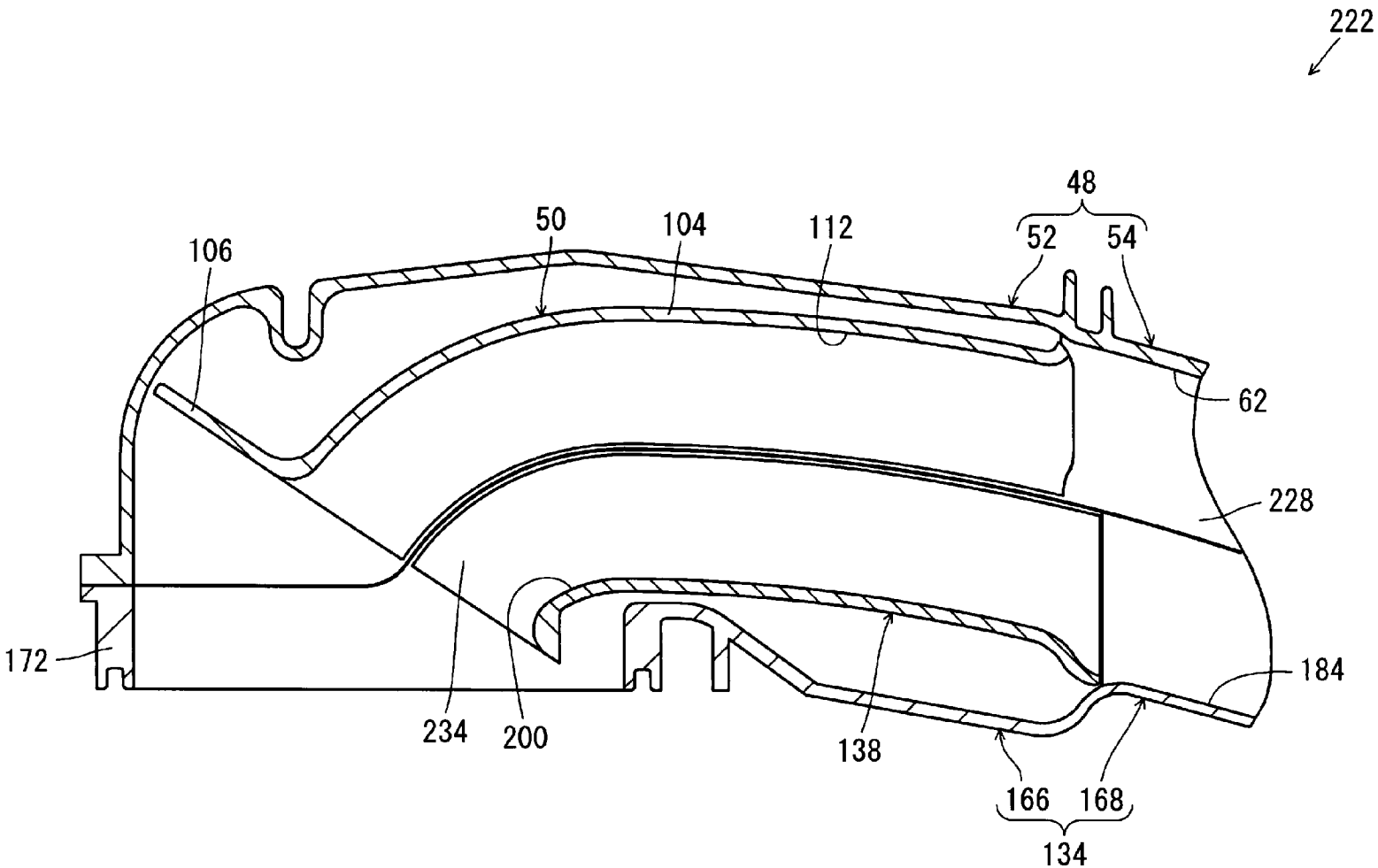
FIG. 18 is a sectional view taken in lines D-D in FIG. 16.

FIG. 16 shows the still another example of intake manifold. FIG. 17 is an exploded perspective view of an intake manifold 222 in FIG. 16. FIG. 18 is a sectional view taken in lines D-D in FIG. 16.

Referring to FIG. 16 and FIG. 17, the intake manifold 222 includes the third member 134 of the intake manifold 132 (see FIG. 12) and the second member 48 of the intake manifold 36 (see FIG. 4). Between the third member 134 and the second member 48, the extension member 50 in FIG. 4 and the extension member 138 in FIG. 12 are preferably fitted.

Referring to FIG. 17, the second member 48 and the third member 134 are attached, preferably via welding, for example, to each other along their outer edge portions into one piece. In this process, the division walls 64, 66 and the division walls 186, 188 come into tight fit respectively to each other. Thus, as shown in FIG. 16, the grooves 58, 60, 62 of the passage formation portion 54 and the grooves 180, 182, 184 of the passage formation portion 168 are fitted to each other to define air intake passages 224, 226, 228.

Referring to FIG. 17, the tabs 50*a*, 50*b*, 50*c* of the extension member 50 are fitted and bonded to the recesses 52*a*, 52*b*, 52*c* of the second member 48. Also, the boss 56 of the second member 48 is inserted into the boss hole 117 in the extension member 50 and the boss hole 206 in the extension member 138, and then into the boss hole 176 in the third member 134. As a result, the extension members 50, 138 are fixed to a predetermined position between the space formation portion 52 and the space formation portion 166. Specifically, the extension member 50 and the extension member 138 are fixed so that the division walls 114, 116 are in proximity to the division walls 202, 204 respectively. Thus, as shown in FIG. 16, the grooves 108, 110, 112 of the extension member 50 and the grooves 196, 198, 200 of the extension member 138 are roughly fitted respectively to each other, to form extension passages 230, 232, 234.

Referring to FIG. 18, the extension member 50 is arranged so that the passage extension portion 104 is in proximity to or in contact with the passage formation portion 54 whereas the extension member 138 is arranged so that it is in proximity to or in contact with the passage formation portion 168. Therefore, the air intake passages 224, 226, 228 (see FIG. 16) and the extension passages 230, 232, 234 are roughly connected respectively with each other.

Referring to FIG. 16, air comes out of the surge tank 34 (see FIG. 2) enters the intake manifold 222, and then branches into the extension passages 230, 232, 234. The air which enters the extension passages 230 goes through the air intake passage 224 and then into the engine 24. The air which enters the extension passages 232 goes through the air intake passage 226 and then into the engine 24. The air which enters the extension passages 234 goes through the air intake passage 228 and then into the engine 24.

As described, in the intake manifold 222, the extension passage 230 and the air intake passage 224 constitute essentially one air intake passage, the extension passage 232 and the air intake passage 226 constitute essentially one air intake passage, and the extension passage 234 and the air intake passage 228 constitute essentially one air intake passage. In the intake manifold 222, a change in the length of the above-described actual air intake passages is made by a selection as to whether or not to fit the extension members 50, 138 thereto. Details will be described hereinafter.

Figure 19:
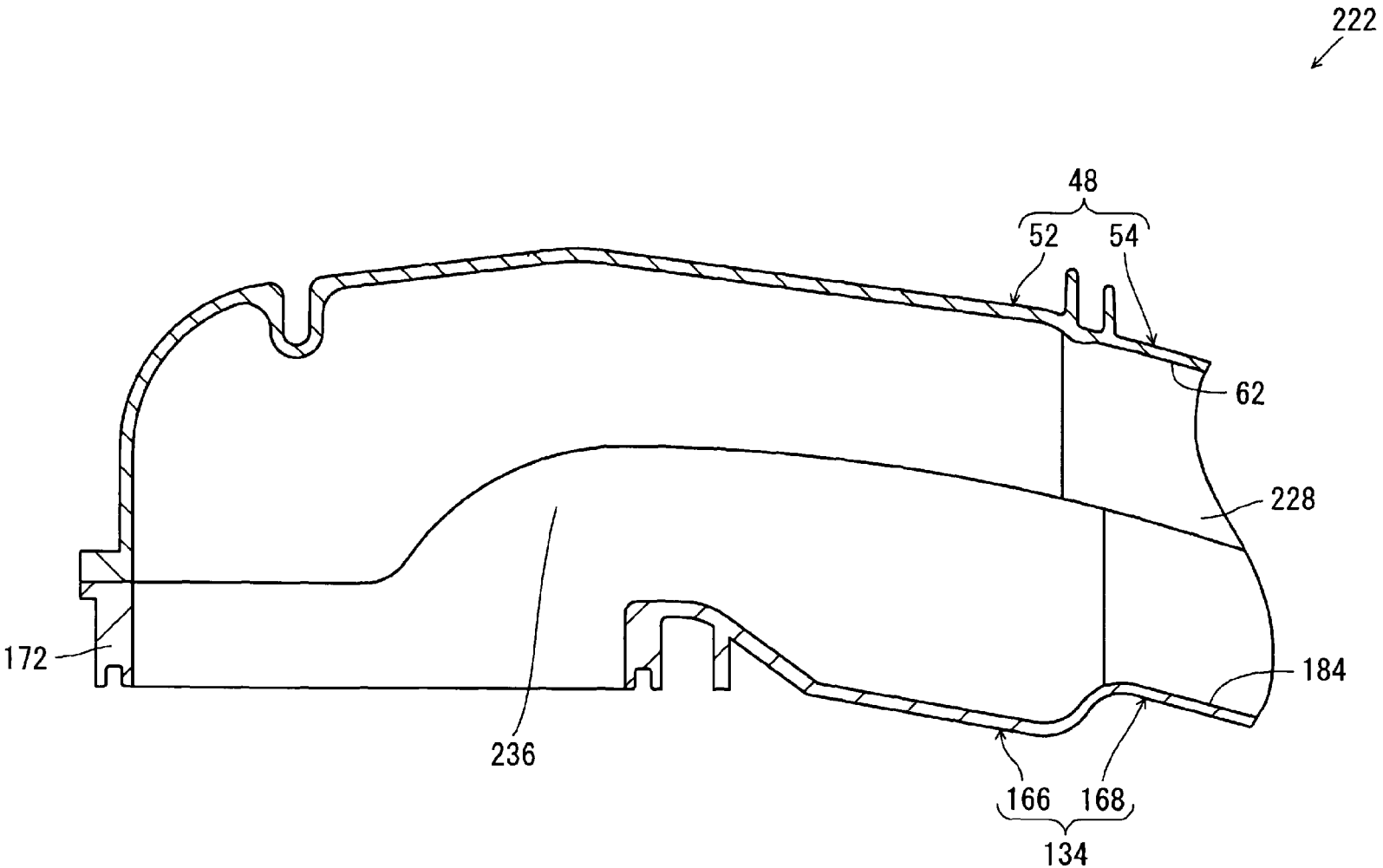
FIG. 19 is a sectional view showing an upstream side of the intake manifold (the same portion is FIG. 18) without an extension member fitted thereto.

FIG. 19 is a sectional view showing an upstream side of the intake manifold 222 (the same portion as in FIG. 18) without the extension members 50, 138 fitted thereto. As shown in FIG. 19, there is an internal space 236 between the space formation portion 52 of the second member 48 and the space formation portion 166 of the third member 134. In the case where the extension members 50, 138 are not fitted, there are no extension passages 230, 232, 234 (see FIG. 16) formed, and therefore the intake manifold 222 provides an internal structure such that the air intake passages 224, 226, 228 (see FIG. 16) branch from the internal space 236. Thus, air which comes from the surge tank 34 (FIG. 2) into the intake manifold 222 flows first into the internal space 236. Thereafter, the air flow is divided from the internal space 236 into the air intake passages 224, 226, 228, and then goes into the engine 24. Therefore, in the case where the extension members 50, 138 are not fitted, the length of the individual air intake passages 224, 226, 228 is the length of the actual air intake passages which lead to the corresponding cylinders 40*a* of the engine 24 (see FIG. 3).

In the present preferred embodiment, the recesses 52*a*, 52*b*, 52*c* and the boss 56 serve as the fitting portions, the space formation portion 166 serves as the third space formation portion, the grooves 180, 182, 184 serve as the fifth groove, the space formation portion 52 serves as the second space formation portion, the grooves 58, 60, 62 serve as the third groove, the extension member 50 serves as the first extension member, the extension member 138 serves as the second extension member, the grooves 108, 110, 112 serve as the ninth grooves, and the grooves 196, 198, 200 serve as the tenth grooves.

As has been described, in the intake manifold 222 according to the present preferred embodiment, it is again possible, as in the intake manifolds 36 and 132 described above, to change the length of the actual air intake passages which lead to the individual cylinders 40*a* of the engine 24 by selecting whether or not to fit the extension members 50, 138 thereto. This arrangement provides sufficient level of adjustment on the intake-air pulsation effect, and is capable of changing the output torque behavior of the engine 24. In this case, the adjustment is capable of changing the output characteristic of the engine 24 while using the third member 134 and the second member 48 (the intake manifold 222) as common components. This eliminates the need for making different types of the third member and the second member (the intake manifold). In other words, it is possible to manufacture two types of boat propelling apparatuses, each having a specific output characteristic for a different purpose from each other, by simply choosing whether or not to fit the extension members 50, 138. The arrangement makes it possible to reduce manufacturing cost of the boat propelling apparatus and boats. Also, since the change in the output characteristic of the engine 24 does not require any alteration in the shape of the intake manifold 222 itself, manufacturing of the intake manifold 222 becomes easy, which makes manufacturing of the boat propelling apparatus easy. Also, the extension members 50, 138 are provided in the internal space 236 of the intake manifold 222, specifically, the extension of the air intake passage is achieved in the internal space 236. This makes it possible to make the boat propelling apparatus very compact.

Also, in the intake manifold 222, the extension members 50, 138 define the extension passages 230, 232, 234, which means there is no need for forming grooves in the space formation portion 52 and the space formation portion 166. Since this makes the intake manifold 222 simpler, manufacture of the intake manifold 222 becomes easy, making it possible to reduce manufacturing cost of the boat propelling apparatus.

Sufficient adjustment on the intake-air pulsation effect is possible even if there is not a complete contact between the division walls 114, 116 in the extension member 50 with the division walls 202, 204 in the extension member 138. In this case, manufacture of the extension members 50, 138 is easy since the division walls 114, 116 and the division walls 202, 204 do not require stringent dimensional control.

It should be noted here that in the above-described preferred embodiment, the boss 56 and the recesses 52*a*, 52*b*, 52*c* are preferably provided as the fitting portions. However, one or more recesses may be provided as fitting portions in the space formation portion of the second member. In this case, the extension member is provided with one or more tabs correspondingly to the one or more recesses in the space formation portion. It should be noted here that both of the boss 56 and the recesses may be provided as the fitting portion, or only one of them may be provided as the fitting portion.

It should be noted here that in the intake manifold 222, one of the extension member 50 and the extension member 138 may be removed to shorten the actual length of the air intake passage. Also, the extension member 50 and the extension member 138 may be integrated into a single piece of extension member.

In the above-described preferred embodiment, the space formation portion 52 and the space formation portion 166 preferably provide the internal space 236. However, the above-described example does not limit how the internal space 236 is provided. For example, other members may also be used, in addition to the space formation portion 52 and the space formation portion 166, to provide the internal space 236.

Also in the above-described preferred embodiment, the grooves 58, 60, 62 and the grooves 180, 182, 184 preferably define the air intake passages 224, 226, 228. However, the above-described example does not limit how the air intake passages 224, 226, 228 are formed. For example, other members may also be used, in addition to the grooves 58, 60, 62 and the grooves 180, 182, 184, to form air intake passages 224, 226, 228.

The grooves 58, 60, 62, 180, 182, 184, 108, 110, 112, 196, 198, 200 need not have a half-circle section, but their sectional shape may be generally polygonal, for example. Further, the grooves 58, 60, 62 and the grooves 180, 182, 184 need not have the same size. For example, the grooves 58, 60, 62 may be greater or smaller than the grooves 180, 182, 184. Likewise, the grooves 108, 110, 112 and the grooves 196, 198, 200 need not have the same size. For example, the grooves 108, 110, 112 may be greater or smaller than the grooves 196, 198, 200.

In the above-described preferred embodiment, description was made for an intake manifold which preferably has three, mutually independent air intake passages, for example. However, the quantity of the air intake passages is not limited to the number given above. For example, the intake manifold may have two, mutually independent air intake passages, or four or more mutually independent air intake passages. In this case, the quantity of the grooves in the space formation portion and in the extension member is determined in accordance with the number of the air intake passages. Therefore, the present invention is applicable to boat propelling apparatuses and boats regardless of the number of cylinders of the engine. Also in the above-described preferred embodiments, the present invention was described for a boat propelling apparatus 14 which preferably includes a V-type engine 24 and a boat 10 which is equipped with the propelling apparatus 14. However, the engine does not have to be the V type. For example, the present invention may be applied to boat propelling apparatus and boat equipped with other types of engines such as a straight engine, a flat engine and a W-type engine.

Figure 20:
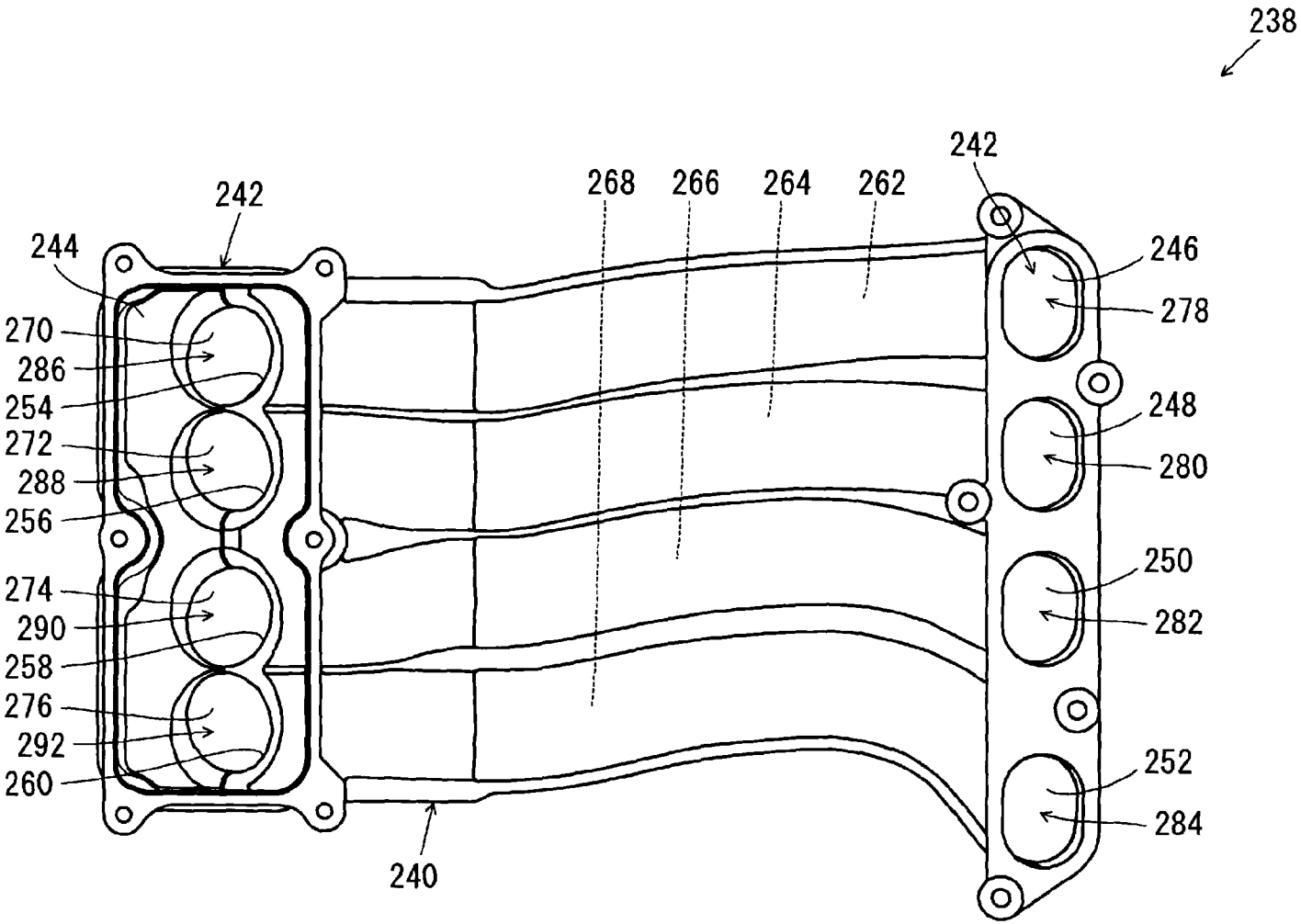
FIG. 20 is a front view showing still another example of the intake manifold.

For example, an intake manifold 238 shown in FIG. 20 may be provided in a straight four-cylinder engine. The intake manifold 238 includes a first member 240 provided on a side of the engine 24 (see FIG. 3), and a second member 242 located farther away from the engine 24 than the first member 240. Between the third member 240 and the second member 242, an extension member 244 is provided. The second member 242 preferably includes four grooves 246, 248, 250, 252 on its downstream side. The first member 240 preferably includes four grooves 254, 256, 258, 260 and four grooves 262, 264, 266, 268 which are located farther downward than the grooves 254, 256, 258, 260. The extension member 244 preferably includes four grooves 270, 272, 274, 276. The extension member 244 is fitted, like the above-described intake manifold 36, to the second member 242 via a boss (not illustrated).

In the intake manifold 238, the grooves 246, 248, 250, 252 and the grooves 262, 264, 266, 268 are paired respectively with each other to define air intake passages 278, 280, 282, 284. Also, the grooves 254, 256, 258, 260 and the grooves 270, 272, 274, 276 are paired respectively with each other to define extension passages 286, 288, 290, 292. The air intake passages 278, 280, 282, 284 and the extension passages 286, 288, 290, 292 are roughly connected with each other, like the above-described intake manifold 36.

As described, the intake manifold 238 has the same configuration as the intake manifold 36, and a change in the length of actual air intake passages is made by a selection as to whether or not to fit the extension members 244.

In the above-described preferred embodiments, the boss for fitting the extension member is preferably provided in the second member or the fourth member. However, the boss may be provided in the first member or the third member. Likewise, the boss may be provided in the extension member while the first member, the second member, the third member or the fourth member is provided with a boss hole for the boss. In this case, the boss hole provided in the first member, the second member, the third member or the fourth member serves as the fitting portion.

The method of fitting the extension member is not limited to those using a boss or recesses. For example, bolt holes may be provided in the first member, the second member, the third member or the fourth member, so that the extension member will be bolted to the first member, the second member, the third member or the fourth member. In this case, bolt holes serve as the fitting portions.

In the above-described preferred embodiment, two intake manifolds are preferably connected with a common surge tank 34. However, a surge tank may be provided for each of the intake manifold.

Also in the above-described preferred embodiments, description was made for a case where the intake manifold is constituted by a first member (third member) provided on the side of the engine 24, and a second member (fourth member) located farther away from the engine 24 than the first member (third member). However, the constitution of the intake manifold is not limited to the above-described preferred embodiments. For example, the intake manifold may be constituted by an upper member (a member which provides a portion above the F-F section as in the intake manifold 132 in FIG. 11 for example), and a lower member (which provides a portion below the F-F section as in the intake manifold 132 in FIG. 11 for example). In this case, the extension member is provided between the upper member and the lower member as sandwiched by the upper member and the lower member from above and below. It should be noted here that the fitting portion(s) (boss or the like) for fitting the extension member is provided appropriately. Also, the first member, the second member, the third member or the fourth member may be constituted by a plurality of members.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propelling apparatus comprising:

a surge tank;

an engine including a plurality of cylinders; and an intake manifold providing an internal space for air to enter from the surge tank, and including a plurality of air intake passages branching from the internal space to supply air to each of the plurality of cylinders; wherein the intake manifold includes a fitting portion to fit an extension member within the internal space of the intake manifold to define within the internal space a plurality of extension passages each corresponding to one of the plurality of air intake passages; and the fitting portion includes a recess to fit the extension member to the intake manifold.

2. A boat propelling apparatus comprising:

a surge tank;

an engine including a plurality of cylinders; and an intake manifold providing an internal space for air to enter from the surge tank, and including a plurality of air intake passages branching from the internal space to supply air to each of the plurality of cylinders; wherein the intake manifold includes a fitting portion to fit an extension member within the internal space of the intake manifold to define within the internal space a plurality of extension passages each corresponding to one of the plurality of air intake passages;

the intake manifold includes a first member provided on a side of the engine, and a second member located farther away from the engine than the first member;

the first member includes a first space formation portion including first grooves in an equal quantity to that of the air intake passages, and second grooves provided downstream from the first space formation portion and extending continuously from the first grooves, respectively;

the second member includes a second space formation portion, and third grooves provided downstream from the second space formation portion and in an equal quantity to that of the air intake passages;

the internal space is defined by at least the first space formation portion and the second space formation portion;

the air intake passages are defined by at least the second grooves and the third grooves; and the fitting portion causes the extension member to be located within the second space formation portion.

3. The boat propelling apparatus according to claim 2, further comprising the extension member, wherein the extension member includes a plurality of fourth grooves each corresponding to one of the first grooves, and the extension passages are defined by at least the first grooves and the fourth grooves.

4. A boat propelling apparatus comprising:

a surge tank;

an engine including a plurality of cylinders; and an intake manifold providing an internal space for air to enter from the surge tank, and including a plurality of air intake passages branching from the internal space to supply air to each of the plurality of cylinders; wherein the intake manifold includes a fitting portion to fit an extension member within the internal space of the intake manifold to define within the internal space a plurality of extension passages each corresponding to one of the plurality of air intake passages;

the intake manifold includes a first member provided on a side of the engine, and a second member located farther away from the engine than the first member;

the first member includes a first space formation portion, and first grooves provided downstream from the first space formation portion and in an equal quantity to that of the air intake passages;

the second member includes a second space formation portion including second grooves in an equal quantity to that of the air intake passages, and third grooves provided downstream from the second space formation portion and extending continuously from the second grooves, respectively;

the internal space is defined by at least the first space formation portion and the second space formation portion;

the air intake passages are defined by at least the first grooves and the third grooves; and the fitting portion causes the extension member to be located within the first space formation portion.

5. The boat propelling apparatus according to claim 4, further comprising the extension member, wherein the extension member includes a plurality of fourth grooves each corresponding to one of the second grooves, and the extension passages are defined by at least the second grooves and the fourth grooves.

6. A boat propelling apparatus comprising:

a surge tank;

an engine including a plurality of cylinders; and an intake manifold providing an internal space for air to enter from the surge tank, and including a plurality of air intake passages branching from the internal space to supply air to each of the plurality of cylinders; wherein the intake manifold includes a fitting portion to fit an extension member within the internal space of the intake manifold to define within the internal space a plurality of extension passages each corresponding to one of the plurality of air intake passages;

the intake manifold includes a first member provided on a side of the engine, and a second member located farther away from the engine than the first member;

the first member includes a first space formation portion, and first grooves provided downstream from the first space formation portion and in an equal quantity to that of the air intake passages;

the second member includes a second space formation portion, and second grooves provided downstream from the second space formation portion and in an equal quantity to that of the air intake passages;

the internal space is defined by at least the first space formation portion and the second space formation portion;

the air intake passages are defined by at least the first grooves and the second grooves.

7. The boat propelling apparatus according to claim 6, further comprising the extension member, wherein the extension member includes a first extension member including third grooves in an equal quantity to that of the air intake passages, and a second extension member includes fourth grooves each corresponding to one of the third grooves, and the extension passages are defined by at least the third grooves and the fourth grooves.

8. A boat comprising the boat propelling apparatus according to claim 1.

9. The boat propelling apparatus according to claim 1, wherein the fitting portion further includes a boss that fixes the extension member within the internal space of the intake manifold at a predetermined position.

10. The boat propelling apparatus according to claim 1, further comprising the extension member, wherein the extension member includes a tab that fits into the recess of the fitting portion when the extension member is fitted within the internal space of the intake manifold.

11. The boat propelling apparatus according to claim 9, further comprising the extension member, wherein the extension member includes a boss hole, and the boss of the fitting portion is inserted through the boss hole of the extension member when the extension member is fitted within the internal space of the intake manifold.

* * * * *